US010072658B2

(12) United States Patent
Kim et al.

(10) Patent No.: US 10,072,658 B2
(45) Date of Patent: Sep. 11, 2018

(54) SCROLL COMPRESSOR

(71) Applicant: LG ELECTRONICS INC., Seoul (KR)

(72) Inventors: Suchul Kim, Seoul (KR); Honggyun Jin, Seoul (KR); Kiwon Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 600 days.

(21) Appl. No.: 14/627,607

(22) Filed: Feb. 20, 2015

(65) Prior Publication Data

US 2015/0233375 A1 Aug. 20, 2015

(30) Foreign Application Priority Data

Feb. 20, 2014 (KR) ..... 10-2014-0019743

(51) Int. Cl.
*F04C 27/00* (2006.01)
*F04C 18/02* (2006.01)
(Continued)

(52) U.S. Cl.
CPC ..... *F04C 27/005* (2013.01); *F04C 18/0207* (2013.01); *F04C 18/0215* (2013.01);
(Continued)

(58) Field of Classification Search
CPC .. F04C 18/0215; F04C 23/008; F04C 27/005; F04C 29/0057; F04C 29/028;
(Continued)

(56) References Cited

U.S. PATENT DOCUMENTS 5,833,443 A * 11/1998 Lifson ..... F04C 27/005 418/55.2
2006/0266076 A1* 11/2006 Lifson ..... F04C 18/0253 62/513

(Continued)

FOREIGN PATENT DOCUMENTS

CN 102016319 4/2011
CN 102203424 9/2011

(Continued)

OTHER PUBLICATIONS

European Search Report dated May 20, 2015.
Chinese Office Action dated Aug. 3, 2016 issued in Application No. 201510087923 (English translation attached).

*Primary Examiner* — Mark Laurenzi
*Assistant Examiner* — Wesley Harris
(74) *Attorney, Agent, or Firm* — KED & Associates, LLP

(57) ABSTRACT

A scroll compressor is provided. The scroll compressor may include a casing including a rotational shaft, a discharge cover fixed at an inside of the casing to partition the inside of the casing into a suction space and a discharge space, a first scroll rotated by the rotational shaft to perform an orbiting motion, a second scroll disposed on or at a side of the first scroll to define a plurality of compression chambers together with the first scroll, the second scroll having an intermediate pressure discharge hole that communicates with a compression chamber having an intermediate pressure among the plurality of compression chambers, a back pressure plate coupled to the second scroll, the back pressure plate having an intermediate pressure suction hole that communicates with the intermediate pressure discharge hole, a floating plate movably disposed on or at a side of the back pressure plate to define a back pressure chamber together with the back pressure plate, and a discharge guide
(Continued)

defined in the first scroll or the second scroll to guide discharge of a refrigerant within the back pressure chamber.

10 Claims, 21 Drawing Sheets

(51) Int. Cl.

| | |
|---|---|
| ***F04C 29/00*** | (2006.01) |
| ***F04C 29/12*** | (2006.01) |
| ***F04C 29/02*** | (2006.01) |
| ***F04C 23/00*** | (2006.01) |
| ***F04C 28/26*** | (2006.01) |
| ***F04C 28/06*** | (2006.01) |

(52) U.S. Cl.
CPC ..... *F04C 18/0246* (2013.01); *F04C 18/0261* (2013.01); *F04C 18/0269* (2013.01); *F04C 18/0284* (2013.01); *F04C 18/0292* (2013.01); *F04C 23/008* (2013.01); *F04C 28/26* (2013.01); *F04C 29/0057* (2013.01); *F04C 29/028* (2013.01); *F04C 29/12* (2013.01); *F04C 29/128* (2013.01); *F04C 28/06* (2013.01); *F04C 2240/603* (2013.01)

(58) Field of Classification Search
CPC ..... F04C 18/0269; F04C 28/26; F04C 29/12; F04C 2240/603; F04C 18/0246; F04C 18/0207; F04C 18/0284; F04C 18/0261; F04C 18/0292
See application file for complete search history.

(56) References Cited

U.S. PATENT DOCUMENTS

| | | | | |
|---|---|---|---|---|
| 2007/0036668 | A1 | 2/2007 | Lifson et al. | |
| 2009/0297377 | A1 | 12/2009 | Stover et al. | |
| 2010/0183453 | A1* | 7/2010 | Milliff | F04C 18/0215 417/310 |
| 2010/0254841 | A1* | 10/2010 | Akei | F04C 18/0215 418/24 |
| 2012/0134863 | A1* | 5/2012 | Collie | F01C 19/005 418/55.1 |
| 2014/0134031 | A1* | 5/2014 | Doepker | F04C 29/126 418/55.1 |

FOREIGN PATENT DOCUMENTS

| | | | | |
|---|---|---|---|---|
| JP | WO 2005010372 | A1 * | 2/2005 | F04C 18/0215 |
| JP | 4335599 | B2 * | 9/2009 | F04C 18/0269 |
| JP | 2011-12638 | | 1/2011 | |
| JP | 2011012638 | | 1/2011 | |
| KR | 10-2000-0037517 | | 6/2001 | |
| KR | 10-1231059 | | 2/2013 | |
| WO | WO 2009/155091 | | 12/2009 | |

* cited by examiner

SCROLL COMPRESSOR

CROSS-REFERENCE TO RELATED APPLICATION

The present application claims priority under 35 U.S.C. 119 and 35 U.S.C. 365 to Korean Patent Application No. 10-2014-0019743, filed in Korea on Feb. 20, 2014, which is hereby incorporated by reference.

BACKGROUND

1. Field

A scroll compressor is disclosed herein.

2. Background

A scroll compressor is a compressor that includes a fixed scroll having a spiral wrap and an orbiting scroll that revolves with respect to the fixed scroll. That is, a scroll compressor is a compressor, in which the fixed scroll and the orbiting scroll are engaged with each other to revolve, thereby reducing a volume of a compression chamber formed between the fixed scroll and the orbiting scroll according to the orbiting motion of the orbiting scroll, and thus, increasing a pressure of a fluid, which is then discharged through a discharge hole formed in or at a central portion of the fixed scroll.

Such a scroll compressor has a feature in which suction, compression, and discharge of a fluid are successively performed while the orbiting scroll revolves. Accordingly, a discharge valve and a suction valve may be unnecessary in principle. Also, as a number of components of the scroll compressor is less, in comparison to other types of compressors, the scroll compressor may be simplified in structure and rotate at a high speed. Also, as a variation in torque required for compression is less, in comparison to other types of compressors, and suction and compression successively occur, a relatively small amount of noise and vibration may occur.

One of important issues in the scroll compressor is leakage and lubrication between the fixed scroll and the orbiting scroll. That is, to prevent a refrigerant from leaking between the fixed scroll and the orbiting scroll, an end of the wrap has to be closely attached to a surface of a head plate to prevent the compressed refrigerant from leaking. The head plate may be understood as a portion that corresponds to a main body of the fixed scroll or the orbiting scroll. That is, the head plate of the fixed scroll may be closely attached to the wrap of the orbiting scroll, and the head plate of the orbiting scroll may be closely attached to the wrap of the fixed scroll.

On the other hand, friction resistance has to be minimized to allow the orbiting scroll to smoothly revolve with respect to the fixed scroll. However, the leakage may conflict with the lubrication. That is, when the end of the wrap and the surface of the head plate are strongly attached to each other, it may be advantageous with respect to leakage, but friction may increase, increasing damage due to noise and abrasion. On the other hand, when adhesion strength is low, friction may be reduced, but a sealing force may decrease, increasing leakage.

Thus, in the related art, a back pressure chamber having an intermediate pressure, which is defined as a value between a discharge pressure and a suction pressure, may be formed on a back surface of the orbiting scroll or the fixed scroll to solve the limitations with respect to sealing and friction. That is, the back pressure chamber that communicates with a compression chamber having an intermediate pressure of a plurality of compression chambers formed between the orbiting scroll and the fixed scroll may be formed to allow the orbiting scroll and the fixed scroll to be adequately attached to each other, thereby solving the limitations with respect to leakage and lubrication.

The back pressure chamber may be formed on a bottom surface of the orbiting scroll or a top surface of the fixed scroll. For convenience of description, a scroll compressor having the back pressure chamber formed on the bottom surface of the orbiting scroll and a scroll compressor having the back pressure chamber formed on the top surface of the fixed scroll are referred to as a lower back pressure type scroll compressor and an upper back pressure type scroll compressor, respectively. The lower back pressure type scroll compressor has advantages in that the lower back pressure type scroll compressor has a simple structure, and a bypass hole is easily formed. However, as the back pressure chamber is formed on the bottom surface of the orbiting scroll, which performs the orbiting motion, the back pressure chamber may change in configuration and position according to the orbiting motion. As a result, the orbiting scroll may be tilted, causing vibration and noise. In addition, an O-ring provided to prevent the refrigerant from leaking may be quickly worn out. The upper back pressure type scroll compressor has a relatively complicated structure. However, as the back pressure chamber is fixed in configuration and position, the fixed scroll may not be tilted, and sealing of the back pressure chamber may be good.

An example of the upper back pressure type scroll compressor is disclosed in Korean Patent Application No. 10-2000-0037517 (hereinafter, referred to as the "'517 application"), entitled "Method for Processing Bearing Housing And Scroll Machine Having Bearing Housing". The drawings of the '517 application include a cross-sectional view illustrating an example of an upper back pressure type scroll compressor according to the related art. The scroll compressor of the '517 application includes an orbiting scroll disposed to revolve on a main frame fixedly installed within a casing, and a fixed scroll engaged with the orbiting scroll. A back pressure chamber is defined on the fixed scroll, and a floating plate to seal the back pressure chamber is disposed to vertically slide along an outer circumference of a discharge passage. A discharge cover is disposed on a top surface of the floating plate to partition an inner space of the compressor into a suction space and discharge space.

The back pressure chamber communicates with one of the compression chambers, and thus, an intermediate pressure is applied to the back pressure chamber. As a result, pressure may be applied upward to the floating plate and applied downward to the fixed scroll. When the floating plate ascends due to the pressure of the back pressure chamber, an end of the floating plate may contact the discharge cover to seal the discharge space. The fixed scroll may move downward and then be closely attached to the orbiting scroll.

However, in the case of the upper back pressure type scroll compressor, when operation of the scroll compressor stops, an intermediate pressure refrigerant of the back pressure chamber may not be easily discharged toward the compression chamber and a suction-side by the orbiting scroll wrap. In detail, when the operation of the scroll compressor stops, the pressure within the scroll compressor may converge to a predetermined pressure (an equilibrium pressure). The equilibrium pressure may be a pressure which is slightly higher than a suction-side pressure. That is, the refrigerant of the compression chamber and the discharge-side refrigerant may be discharged, and the inside of the compressor may converge to the equilibrium pressure. Then, when the compressor re-operates or starts operating again, the compressor may operate while a difference between the equilibrium pressure and a pressure at each position occurs.

It is unnecessary to maintain the equilibrium pressure while the refrigerant of the back pressure chamber is discharged to the suction-side. If the refrigerant of the back pressure chamber is not discharged, the fixed scroll may be decompressed downward by the pressure of the back pressure chamber, and thus, may be maintained in a state in which the fixed scroll is closely attached to the orbiting scroll.

Also, if the refrigerant of the back pressure chamber is not discharged, the pressure of the back pressure chamber may be maintained at the equilibrium pressure. Accordingly, the floating plate may move upward to contact the discharge cover. As a result, the discharge passage for the discharge-side refrigerant may be blocked, preventing the discharge-side refrigerant from being discharged to the suction-side of the compressor, thereby further pressing the fixed scroll downward.

As described above, when the fixed scroll is pressed to maintain the state in which the fixed scroll is closely attached to the orbiting scroll at a pressure greater than a predetermined pressure, it may be difficult to quickly drive the scroll compressor again. As a result, to quickly drive the scroll compressor again, a high initial torque of the compressor may be required. When the initial torque increases, noise and abrasion may occur, reducing operation efficiency of the compressor.

As described above, the refrigerant of the back pressure chamber has to be discharged toward the compression chamber and the suction-side when the operation of the compressor stops. However, in the case of the upper back pressure type scroll compressor according to the related art, when the compressor operates and then stops, the wrap of the revolving orbiting scroll may be disposed at one point of the head plate of the fixed scroll. The orbiting scroll may stop in a state in which an end of the orbiting scroll blocks one point of or on the head plate that communicates with the back pressure chamber, that is, a discharge hole to discharge the intermediate pressure refrigerant into the back pressure chamber.

When the discharge hole is blocked by the wrap of the orbiting scroll, the discharge of the refrigerant of the back pressure chamber into the compression chamber and the suction-side may be limited. As a result, quick re-operation of the compressor may be limited.

FIG. 1 of the present application illustrates a variation in pressure within the compressor when the scroll compressor according to the related art operates and stops, where $P_1$ is a pressure of the refrigerant discharged from the compressor, $P_2$ is an intermediate pressure of the refrigerant of the back pressure chamber, $P_3$ is a pressure of the discharge cover-side refrigerant, and $P_4$ is a pressure of the suction-side refrigerant. In detail, referring to FIG. 1 of the present application, the scroll compressor according to the related art may stop at a time $t_0$ after the scroll compressor operates. After the scroll compressor stops, the inside of the scroll compressor may converge to a predetermined pressure.

However, as the refrigerant of the back pressure chamber is not discharged to the compression chamber and the suction-side of the compressor, convergence of the inner pressure of the compressor to the equilibrium pressure may be limited or prevented. That is, the equilibration between the suction-side pressure $P_4$ and other pressures may be limited or prevented, causing a predetermined pressure difference $\Delta P$.

Also, after the compressor stops, the compressor may not be quickly re-operated at a time $t_1$, due to the pressure difference within the compressor. However, the orbiting scroll may re-operate at a time $t_2$ after a predetermined time elapses.

BRIEF DESCRIPTION OF THE DRAWINGS

Embodiments will be described in detail with reference to the following drawings in which like reference numerals refer to like elements, and wherein.

DETAILED DESCRIPTION

Figure 1:
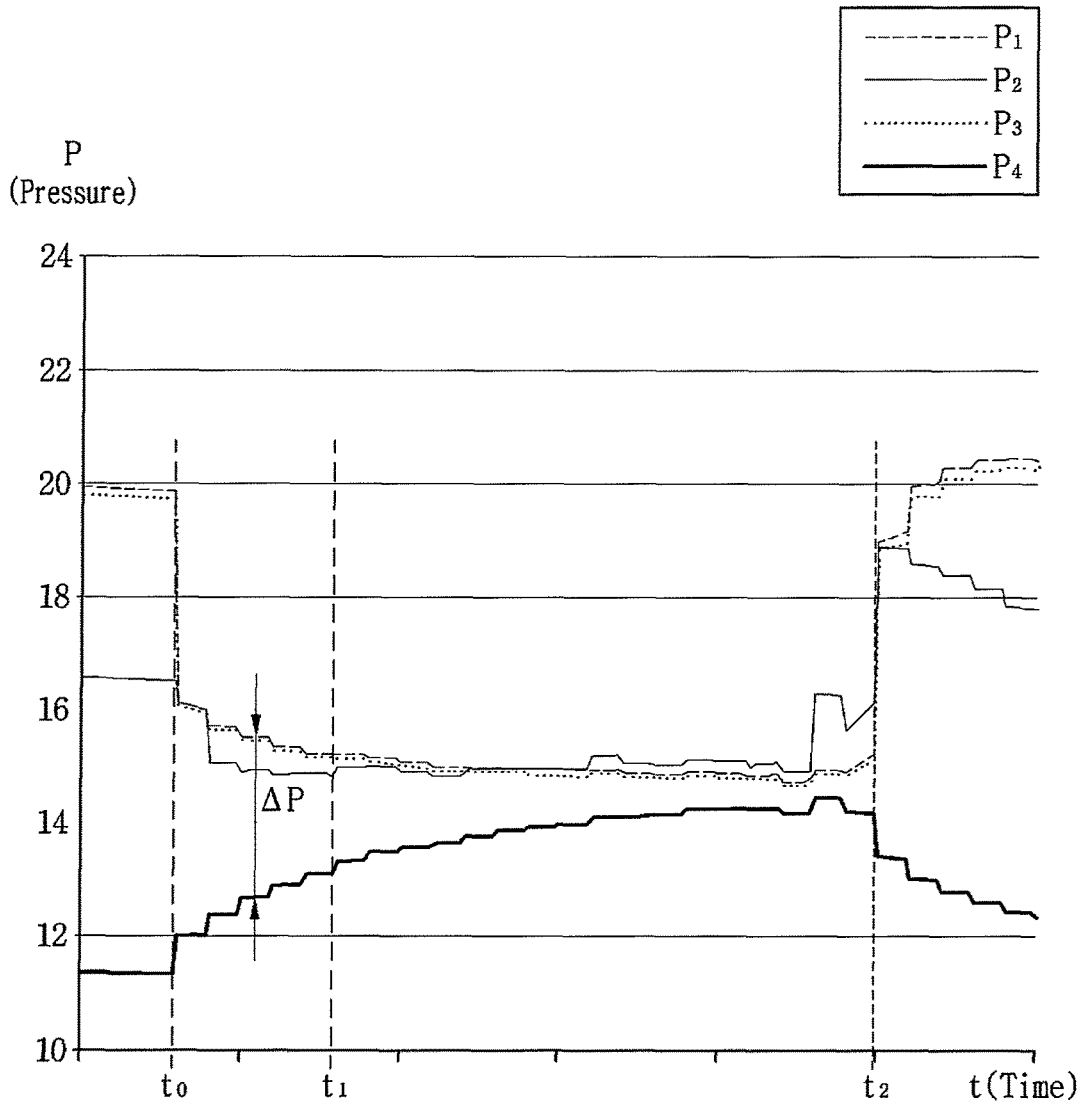
FIG. 1 is a graph illustrating a variation in inner pressure of a compressor when the compressor stops and then re-operates in a scroll compressor according to a related art.
Figure 2:
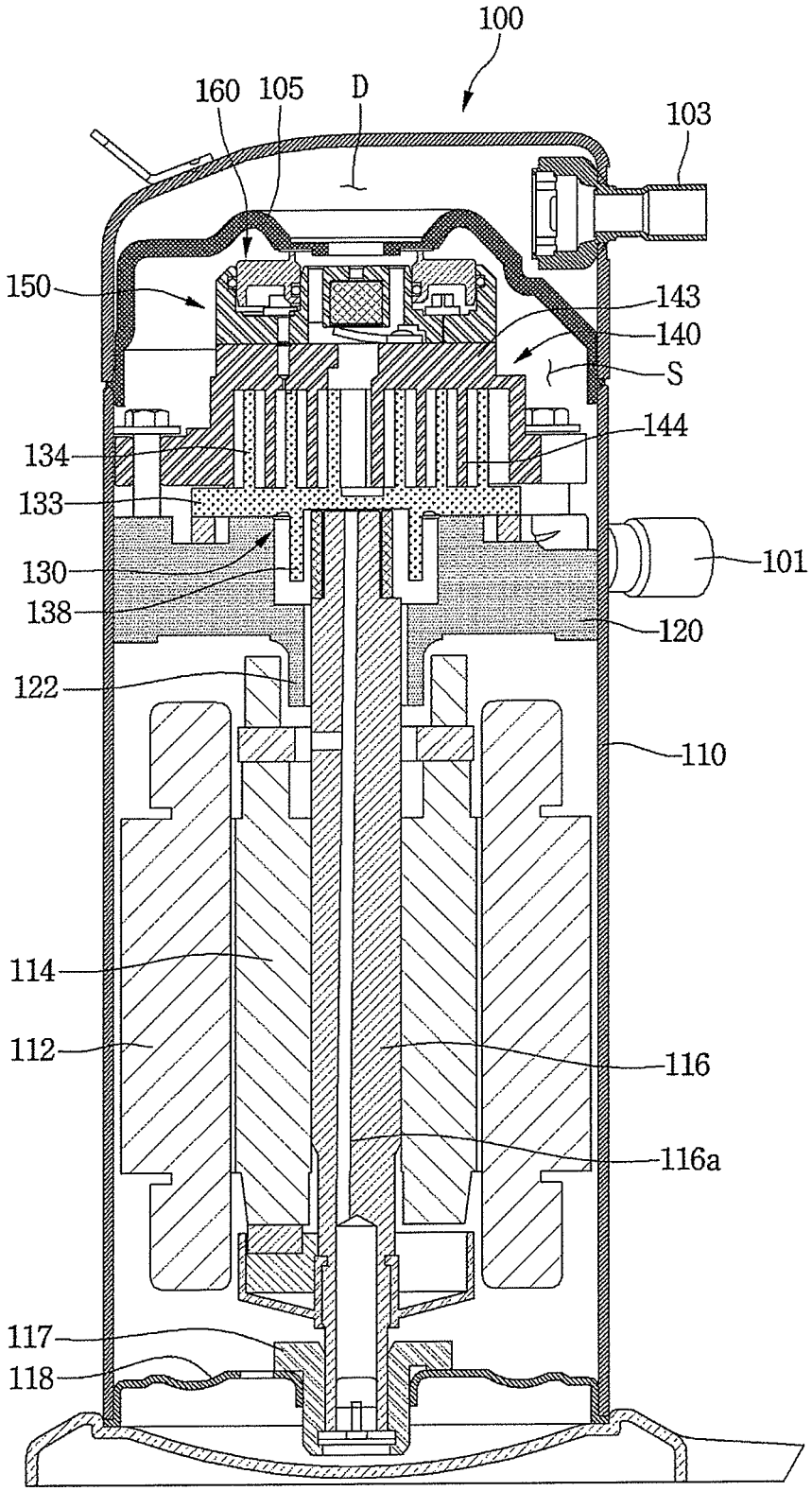
FIG. 2 is a cross-sectional view of a scroll compressor according to an embodiment.
Figure 3:
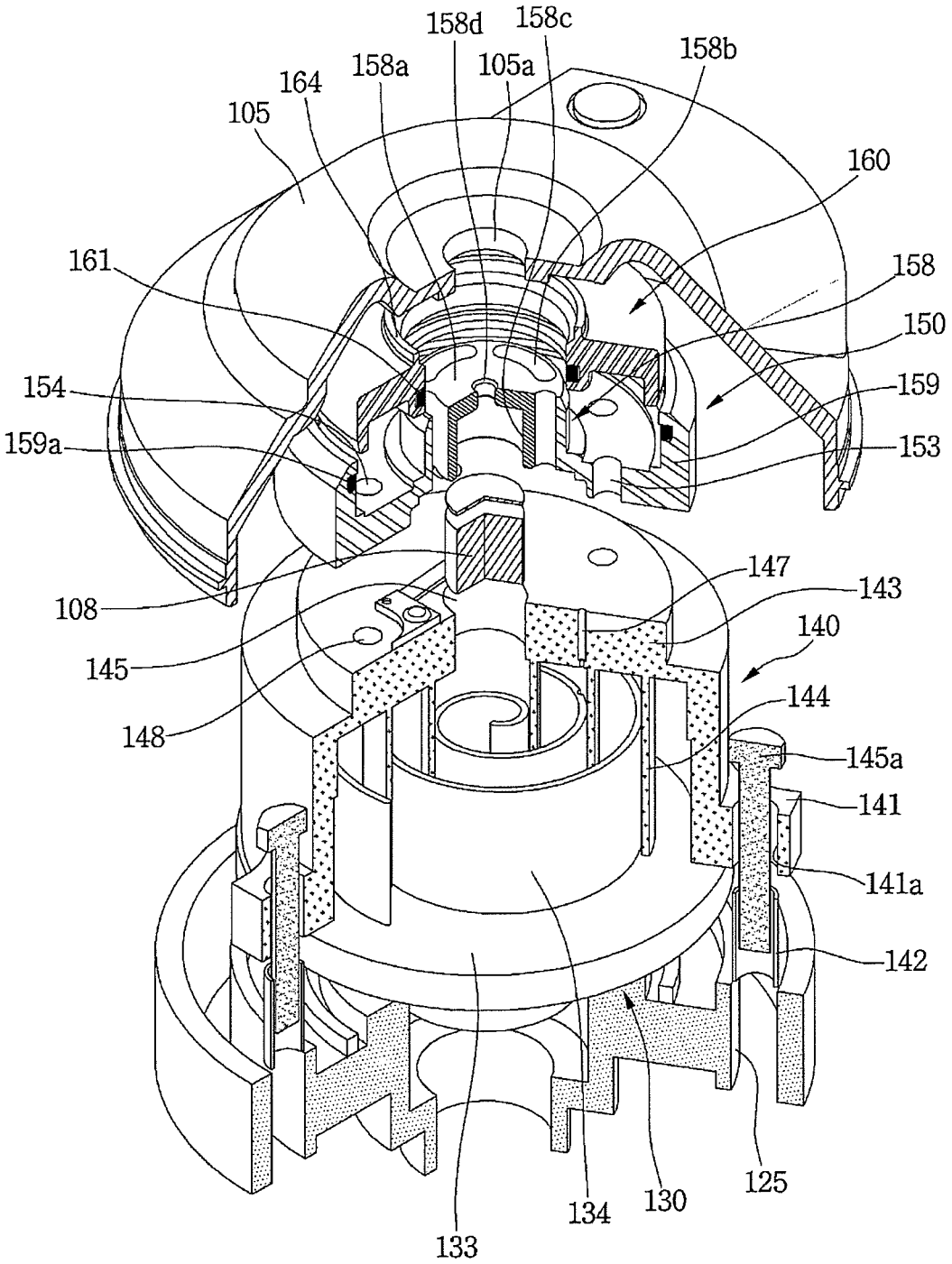
FIG. 3 is a partial exploded cross-sectional view of the scroll compressor according to an embodiment.
Figure 4:
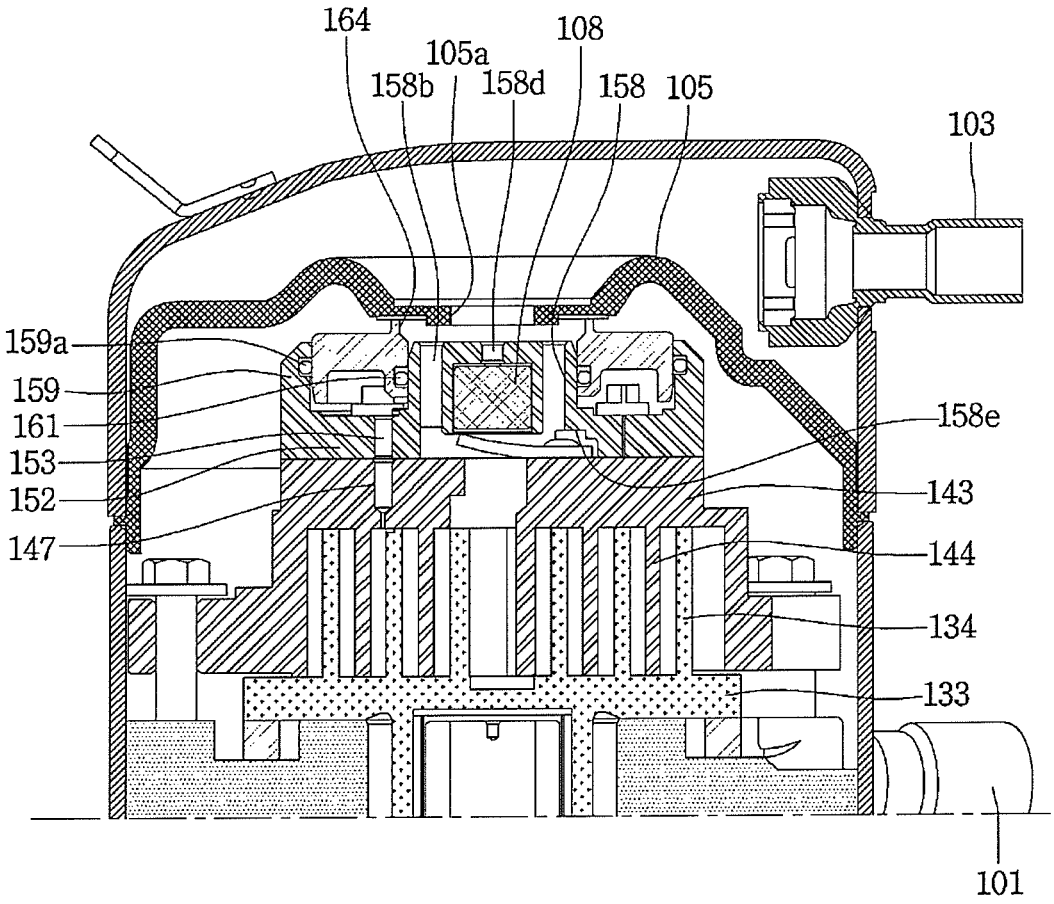
FIG. 4 is a cross-sectional view illustrating a portion of the scroll compressor according to an embodiment.

FIG. 2 is a cross-sectional view of a scroll compressor according to an embodiment. FIG. 3 is a partial exploded cross-sectional view of the scroll compressor according to an embodiment. FIG. 4 is a cross-sectional view illustrating a portion of the scroll compressor according to an embodiment.

Referring to FIGS. 2 to 4, a scroll compressor 100 according to an embodiment may include a casing 110 having a suction space S and a discharge space D. A discharge cover 105 may be disposed in or at an inner upper portion of the casing 110. An inner space of the casing 110 may be partitioned into the suction space S and the discharge space D by the discharge cover 105. An upper side of the discharge cover 105 may correspond to the discharge space D, and a lower side of the discharge cover 105 may correspond to the suction space S. A discharge hole 105*a*, through which a refrigerant compressed at or to a high pressure may be discharged, may be defined in an approximately central portion of the discharge cover 105.

The scroll compressor 100 may further include a suction inlet 101 that communicates with the suction space S, and a discharge outlet 103 that communicates with the discharge space D. Each of the suction inlet 101 and the discharge outlet 103 may be fixed to the casing 101 to allow the refrigerant to be suctioned into the casing 110 or discharged outside of the casing 110.

A motor may be disposed in or at a lower portion of the suction space S. The motor may include a stator 112 coupled to an inner wall of the casing 110, a rotor 114 rotatably disposed within the stator 112, and a rotational shaft 116 that passes through a central portion of the stator 114. A lower portion of the rotational shaft 116 may be rotatably supported by an auxiliary bearing 117 disposed at a lower portion of the casing 110. The auxiliary bearing 117 may be coupled to a lower frame 118 to stably support the rotational shaft 116.

The lower frame 118 may be fixed to the inner wall of the casing 110, and a bottom surface of the casing 110 may be used as an oil storage space. Oil stored in the oil storage space may be transferred upward by an oil supply passage 116*a* defined in the rotational shaft 116 and uniformly supplied into the casing 110. The oil supply passage 116*a* may be eccentrically disposed toward one side so that the oil introduced into the oil supply passage 116*a* may flow upward by a centrifugal force generated by rotation of the rotational shaft 116.

An upper portion of the rotational shaft 116 may be rotatably supported by a main frame 120. The main frame 120 may be fixed to the inner wall of the casing 110 by, for example, the lower frame 118. A main bearing 122 that protrudes downward may be disposed on a bottom surface of the main frame 120. The rotational shaft 116 may be inserted into the main bearing 122. An inner wall of the main bearing 122 may function as a bearing surface so that the rotational shaft 116 may smoothly rotate.

An orbiting scroll 130 may be disposed on a top surface of the main frame 120. The orbiting scroll 130 may include a first head plate 133 having an approximately circular plate shape and placed on the main frame 120, and an orbiting wrap 134 having a spiral shape, that extends from the first head plate 133. The first head plate 133 may define a lower portion of the orbiting scroll 130 and may function as a main body of the orbiting scroll 130, and the orbiting wrap 134 may extend upward from the first head plate 133 to define an upper portion of the orbiting scroll 130. The orbiting wrap 134 together with a fixed wrap 144, which will be described hereinbelow, of a fixed scroll 140 may define a compression chamber. The orbiting scroll 130 may be referred to as a "first scroll", and the fixed scroll 140 may be referred to as a "second scroll".

The first head plate 133 of the orbiting scroll 130 may revolve in a state in which the first head plate 133 is supported on the top surface of the main frame 120. An Oldham ring may be disposed between the first head plate 133 and the main frame 120 to prevent the orbiting scroll 130 from revolving. A boss 138, into which the upper portion of the rotational shaft 116 may be inserted, may be disposed on a bottom surface of the first head plate 133 of the orbiting scroll 130 to easily transmit a rotational force of the rotational shaft 116 to the orbiting scroll 130.

The fixed scroll 140 engaged with the orbiting scroll 130 may be disposed on the orbiting scroll 130. The orbiting scroll 130 may include a plurality of pin supports 141 that protrudes from an outer circumferential surface of the orbiting scroll 130 and each of which may have a guide hole 141*a*, a guide pin 142 inserted into the guide hole 141*a* and disposed on the top surface of the main frame 120, and a coupling member 145*a* inserted into the guide pin 142 and fitted into an insertion hole 125 of the main frame 120.

The fixed scroll 140 may include a second head plate 143 having a disk shape, and the fixed wrap 144 that extends from the second head plate 143 toward the first head plate 133 and engaged with the orbiting wrap 134 of the orbiting scroll 130. The second head plate 143 may define an upper portion of the fixed scroll 140 and function as a main body of the fixed scroll 140, and the fixed wrap 144 may extend downward from the second head plate 143 to define a lower portion of the fixed scroll 140. For convenience of description, the orbiting wrap 134 may be referred to as a "first wrap", and the fixed wrap 144 may be referred to as a "second wrap".

An end of the fixed wrap 144 may be disposed to contact the first head plate 133, and an end of the orbiting wrap 134 may be disposed to contact the second head plate 143. The fixed wrap 144 may extend in a predetermined spiral shape, and a discharge hole 145, through which the compressed refrigerant may be discharged, may be defined in an approximately central portion of the second head plate 143. A suction hole (see reference numeral 146 of FIG. 5), through which the refrigerant within the suction space S may be suctioned, may be defined in a side surface of the fixed scroll 140. The refrigerant suctioned through the suction hole 146 may be introduced into the compression chamber defined by the orbiting wrap 134 and the fixed wrap 144.

In detail, the fixed wrap 144 and the orbiting wrap 134 may define a plurality of compression chambers. Each of the plurality of compression chambers may be reduced in volume while revolving and moving to the discharge hole-side to compress the refrigerant. Thus, the compression chamber adjacent to the suction hole 146 may be minimized in pressure, and the compression chamber that communicates with the discharge hole 145 may be maximized in pressure. The compression chamber between the above-described compression chambers may have an intermediate pressure, which may be between a suction pressure of the suction hole 146 and a discharge pressure of the discharge hole 145. The intermediate pressure may be applied to a back pressure chamber BP, which will be described hereinbelow, to press the fixed scroll 140 toward the orbiting scroll 130.

An intermediate pressure discharge hole 147 to transfer the refrigerant of the compression chamber having the intermediate pressure to the back pressure chamber BP may be defined in the second head plate 143 of the fixed scroll 140. That is, the intermediate pressure discharge hole 147 may be defined in or at a portion of the fixed scroll 130 at which a pressure in the compression chamber that communicates with the intermediate pressure discharge hole 147 is greater than a pressure in the suction space S and less than a pressure in the discharge space D. The intermediate pressure discharge hole 147 may pass from a top surface to a bottom surface of the second head plate 143.

A back pressure chamber assembly 150 and 160 to define the back pressure chamber BP may be disposed on the fixed scroll 140. The back pressure chamber assembly 150 and 160 may include a back pressure plate 150, and a floating plate 160 separably coupled to the back pressure plate 150, and may be fixed to the upper portion of the second head plate 143 of the fixed scroll 140.

The back pressure plate 150 may have an approximately annular shape with a hollow, and may include a support 152 that contacts the second head plate 143 of the fixed scroll 140. An intermediate pressure suction hole 153 that communicates with the intermediate pressure discharge hole 147 may be defined in the support 152. The intermediate pressure suction hole 153 may pass from a top surface to a bottom surface of the support 152.

A second coupling hole 154 that communicates with a first coupling hole 148 defined in the second head plate 143 of the fixed scroll 140 may be defined in the support 152. The first coupling hole 148 and the second coupling hole 154 may be coupled to each other by a predetermined coupling member, for example.

The back pressure plate 150 may include a plurality of walls 158 and 159 that extends upward from the support 152. The plurality of walls 158 and 159 may include a first wall 158 that extends upward from an inner circumferential surface of the support 152, and a second wall 159 that extends upward from an outer circumferential surface of the support 152. Each of the first and second walls 158 and 159 may have an approximately cylindrical shape.

The first and second walls 158 and 159 together with the support 152 may define a space having a predetermined shape. The space may define the above-described back pressure chamber BP.

The first wall 158 may include a top surface 158*a*. Further, the first wall 158 may include an intermediate discharge hole 158*b* that communicates with the discharge hole 145 of the second head plate 143 to discharge the refrigerant discharged from the discharge hole 145 toward the discharge cover 105. A plurality of the intermediate discharge hole 158*b* may be provided and pass from a bottom surface of the first wall 158 to the top surface 158*a*. An inner space of the first wall 158 having a cylindrical shape may communicate with the discharge hole 145 to define a portion of a discharge passage to transfer the discharged refrigerant to the discharge space D.

A discharge valve 108 having an approximately circular pillar shape may be disposed inside the first wall 158. The discharge valve 108 may be disposed on the discharge hole 145, and have a size sufficient to completely cover the discharge hole 145. Thus, when the discharge valve 108 contacts the second head plate 143 of the fixed scroll 140, the discharge valve 108 may close the discharge hole 145.

The discharge valve 108 may be movable upward or downward according to a variation in pressure applied to the discharge valve 108. Also, the inner circumferential surface of the first wall 158 may define a moving guide 158*c* to guide movement of the discharge valve 108.

A discharge pressure applying hole 158*d* may be defined in the top surface 158*a* of the first wall 158. The discharge pressure applying hole 158*d* may communicate with the discharge hole D. The discharge pressure applying hole 158*d* may be defined in an approximately central portion of the top surface 158*a*, and the plurality of intermediate discharge holes 158*b* may be disposed to surround the discharge pressure applying hole 158*d*.

For example, when operation of the scroll compressor 100 stops, if the refrigerant flows backward from the discharge space D toward the discharge hole 145, the pressure applied to the discharge pressure applying hole 158*d* may be greater than the discharge hole-side pressure. That is, the pressure may be applied downward to a top surface of the discharge valve 108, and thus, the discharge valve 108 may move downward to close the discharge hole 145.

On the other hand, if the scroll compressor 100 operates to compress the refrigerant in the compression chamber, when the discharge hole-side pressure is greater than a pressure in the discharge space D, an upward pressure may be applied to a bottom surface of the discharge valve 108, and thus, the discharge valve 108 may move upward to open the discharge hole 145. When the discharge hole 145 is opened, the refrigerant discharged from the discharge hole 145 may flow toward the discharge cover 105 via the intermediate discharge hole 158*b*, and then, may be discharged to the outside of the compressor 100 through the discharge outlet 103 via the discharge hole 105*a*.

The back pressure plate 150 may include a step 158*e* disposed inside a portion at which the first wall 158 and the support 152 are connected to each other. The refrigerant discharged from the discharge hole 145 may reach a space defined by the step 158*e* to flow to the intermediate discharge hole 158*b*. The second wall 159 may be spaced a predetermined distance from the first wall 158 to surround the first wall 158.

The back pressure plate 150 may include a space having an approximately U-shaped cross-section formed by the first wall 158, the second wall 159, and the support 152. The floating plate 160 may be disposed in the space. The space which may be covered by the floating plate 160, may define the back pressure chamber BP.

Alternatively, a space defined by the first and second walls 158 and 159 of the back pressure plate 150, the support 152, and the floating plate 160 may define the back pressure chamber BP.

The floating plate 160 may have an annular plate shape and include an inner circumferential surface that faces the outer circumferential surface of the first wall 158 and an outer circumferential surface that faces the inner circumferential surface of the second wall 159. That is, the inner circumferential surface of the floating plate 160 may be disposed to contact the outer circumferential surface of the first wall 158, and the outer circumferential surface of the floating plate 160 may be disposed to contact the inner circumferential surface of the second wall 159.

O-rings 159*a* and 161 may be disposed on or at contact portions between the floating plate 160 and the first and second walls 158 and 159, respectively. In detail, the O-rings 159*a* and 161 may include a first O-ring 159*a* disposed on or at a contact portion between the inner circumferential surface of the second wall 159 and the outer circumferential surface of the floating plate 160, and a second O-ring 161 disposed on or at a contact portion between the outer circumferential surface of the first wall 158 and the inner circumferential surface of the floating plate 160.

For example, the first O-ring 159*a* may be disposed on the inner circumferential surface of the second wall 159, and the second O-ring 161 may be disposed on the inner circumferential surface of the floating plate 160. Leakage through contact surfaces between the first and second walls 158 and 159 and the floating plate 160, that is, refrigerant leakage from the back pressure chamber BP may be prevented by the O-rings 159*a* and 161.

A rib 164 that extends upward may be disposed on the top surface of the floating plate 160. For example, the rib 164 may extend upward from the inner circumferential surface of the floating plate 160.

The rib 164 may be movably disposed to selectively contact a bottom surface of the discharge cover 105. When the rib 164 contacts the discharge cover 105, the suction space S and the discharge space D may be partitioned. On the other hand, when the rib 164 is spaced from the bottom surface of the discharge cover 105, that is, when the rib 164 moves in a direction away from the discharge cover 105, the suction space S and the discharge space D may communicate with each other.

In detail, while the scroll compressor 100 operates, the floating plate 160 may move upward to allow the rib 164 to contact the bottom surface of the discharge cover 105. Thus, the rib may serve as a sealing member so that the refrigerant discharged from the discharge hole 145 and passing through the intermediate discharge hole 158*b* does not leak into the suction space S, but rather, is discharged into the discharge space D.

On the other hand, when the scroll compressor 100 stops, the floating plate 160 may move downward to allow the rib 164 to be spaced apart from the bottom surface of the discharge cover 105. Thus, the discharged refrigerant disposed at the discharge cover-side may flow toward the suction space S through the space between the rib 164 and the discharge cover 105.

Figure 5:
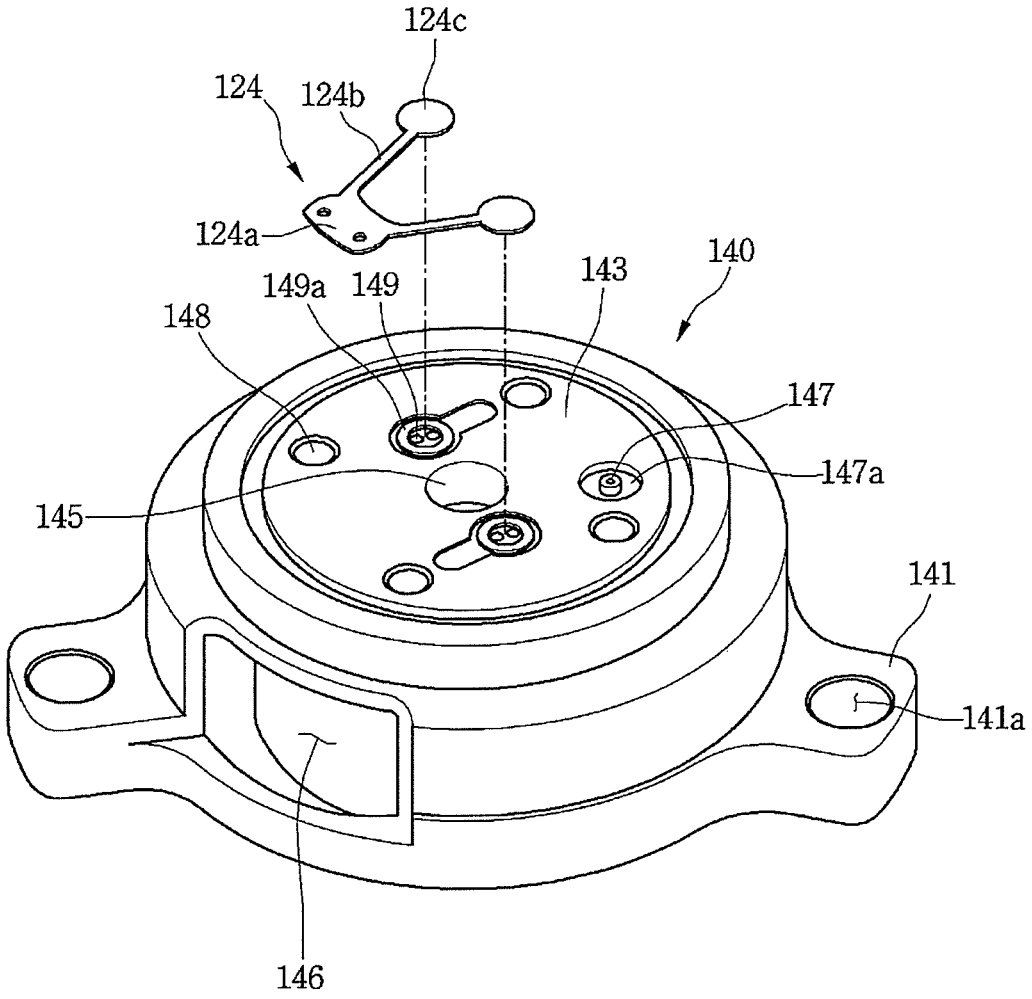
FIG. 5 is a perspective view of a fixed scroll according to an embodiment.
Figure 6:
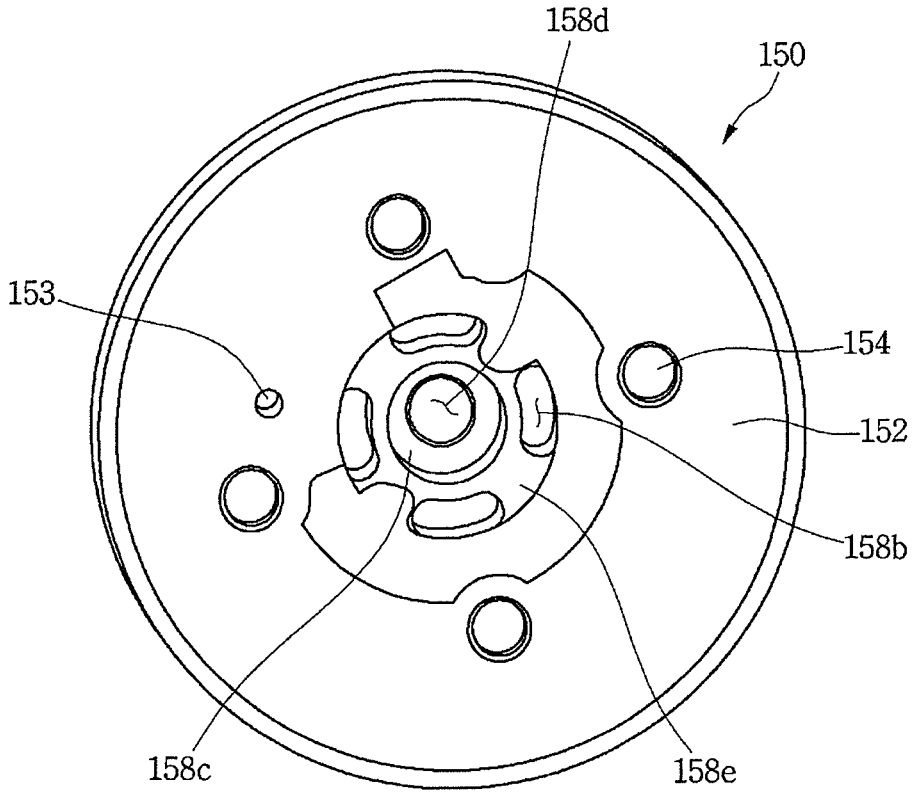
FIG. 6 is a plan view illustrating a bottom surface of a back pressure plate according to an embodiment.
Figure 7:
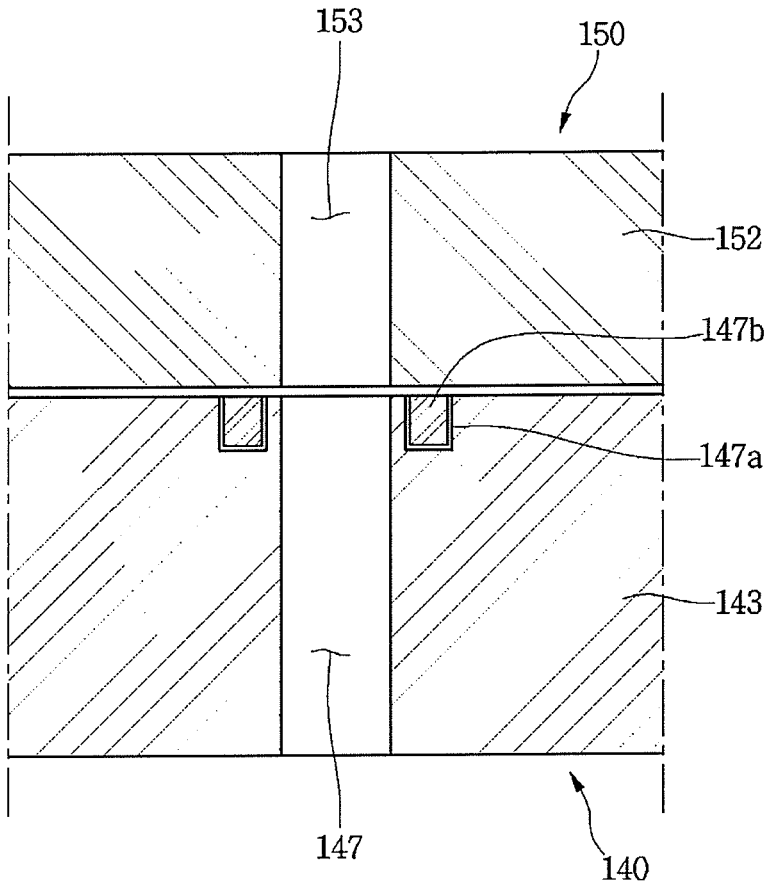
FIG. 7 is a partial enlarged cross-sectional view of the fixed plate and the back pressure plate according to an embodiment.

FIG. 5 is a perspective view of a fixed scroll according to an embodiment. FIG. 6 is a plan view illustrating a bottom surface of a back pressure plate according to an embodiment. FIG. 7 is a partial enlarged cross-sectional view of the fixed plate and the back pressure plate according to an embodiment.

Referring to FIGS. 5 to 7, the fixed scroll 140 according to an embodiment may include a bypass hole 149 defined at each of opposite sides of the discharge hole 145. The bypass hole 149 may include two through-holes. The bypass hole 149 may pass through the second head plate 143 to extend up to the compression chamber defined by the fixed wrap 144 and the orbiting wrap 134.

The bypass hole 149 may be defined at a different position according to operation conditions. For example, the bypass hole 149 may communicate with the compression chamber having a pressure which is greater by about 1.5 times than the suction pressure. Also, the compression chamber that communicates with the bypass hole 149 may have a pressure greater than a pressure of the compression chamber that communicates with the intermediate pressure discharge hole 147.

The fixed scroll 140 may include a wall 149*a* that surrounds an outer circumference of the bypass hole 149. The wall 149*a* may contact a valve body 124*c* of a bypass valve 124, which will be described hereinbelow, to provide a space in which the refrigerant discharged from the bypass hole 149 may temporarily stay.

Referring again to FIGS. 3 and 4, the scroll compressor 100 according to an embodiment may include the bypass valve 124 to open and close the bypass hole 149. In detail, the bypass valve 124 may include a valve support 124*a* fixed to the second head plate 143 of the fixed scroll 140 by a predetermined coupling member or device, for example. The coupling member or device may include a rivet, bolt, or screw, for example.

The bypass valve 124 may further include a connection portion 124*b* that extends from the valve support 124*a*, and the valve body 124*c* disposed on or at a side of the connection portion 124*b*. If an external force is not applied to the valve body 124*c*, contact between the valve body 124*c* and the wall 149*a* may be maintained. The valve body 124*c* may have a size sufficient to cover the wall 149*a*.

When the bypass valve 124 is opened, the refrigerant of the compression chamber that communicates with the bypass hole 149 may flow into a space between the fixed scroll 140 and the back pressure plate 150 through the bypass hole 149 to bypass the discharge hole 145. The bypassed refrigerant may flow toward the discharge hole 105*a* of the discharge cover 105 via the intermediate discharge hole 158*b*.

The intermediate pressure discharge hole 147 of the fixed scroll 140 and the intermediate pressure suction hole 153 of the back pressure plate 150 may be aligned with each other. The refrigerant discharged from the intermediate pressure discharge hole 147 may be introduced into the back pressure chamber BP via the intermediate pressure suction hole 153. The intermediate pressure discharge hole 147 and the intermediate pressure suction hole 153 may be referred to as a "bypass passage" in that the refrigerant of the back pressure chamber BP may be bypassed to the compression chamber through the intermediate pressure discharge hole 147 and the intermediate pressure suction hole 153. The fixed scroll 140 may have an intermediate pressure sealing groove 147*a*, in which an intermediate pressure O-ring 147*b* disposed around the intermediate pressure discharge hole 147 to prevent the refrigerant discharged from the intermediate pressure discharge hole 147 from leaking may be disposed.

Figure 8:
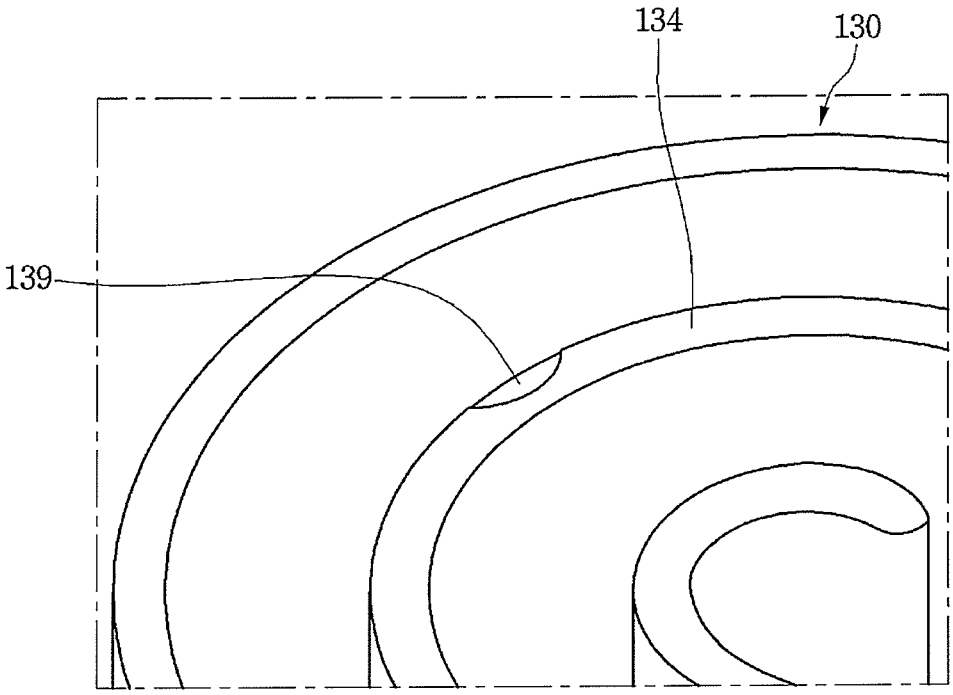
FIG. 8 is a view illustrating a portion of an orbiting scroll according to an embodiment.
Figure 9:
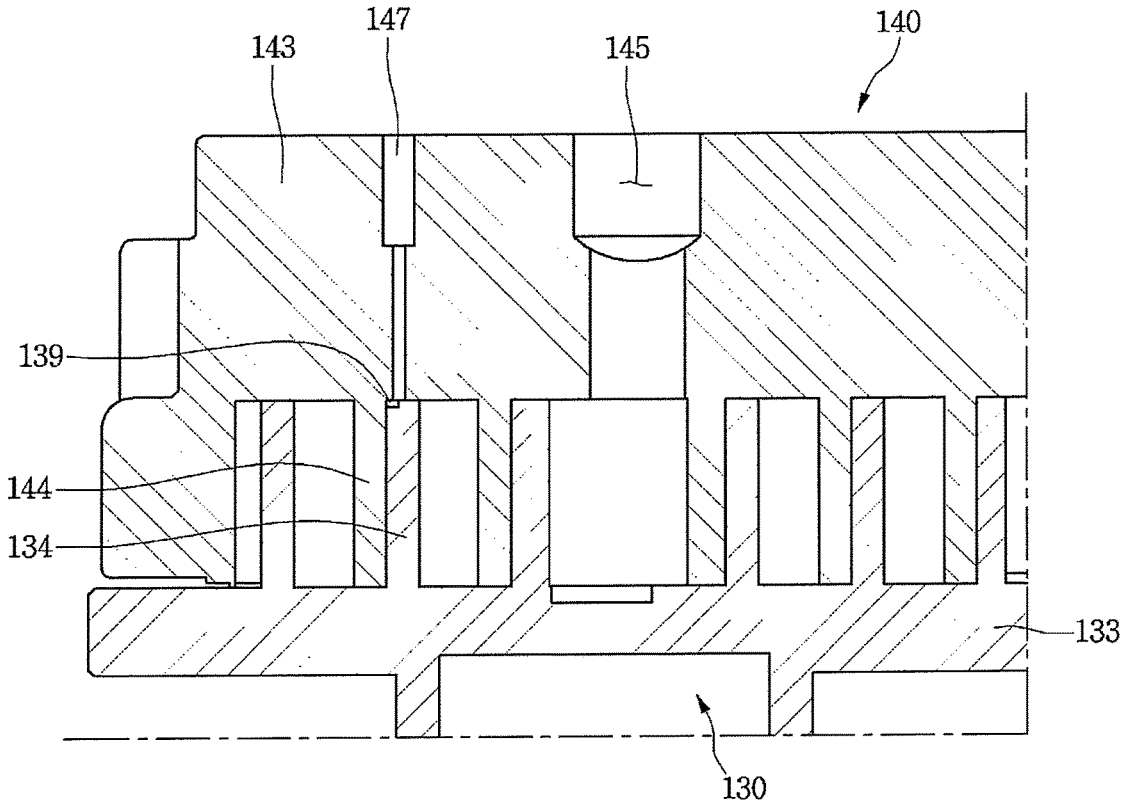
FIG. 9 is a cross-sectional view illustrating a coupled state of the fixed scroll and the orbiting scroll according to an embodiment.
Figure 10A:
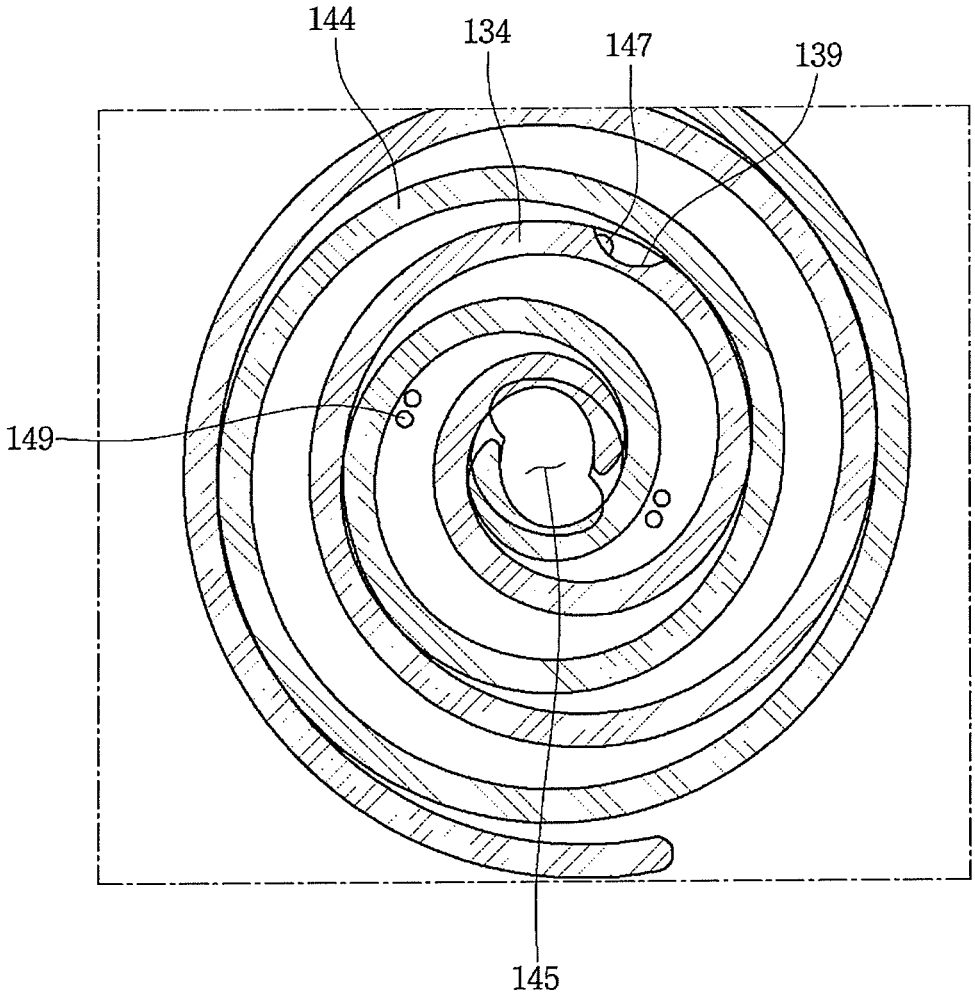
FIGS. 10A to 10C are views illustrating relative positions of an intermediate pressure discharge hole of the fixed scroll and a discharge guide of the orbiting scroll while the orbiting scroll revolves.
Figure 10B:
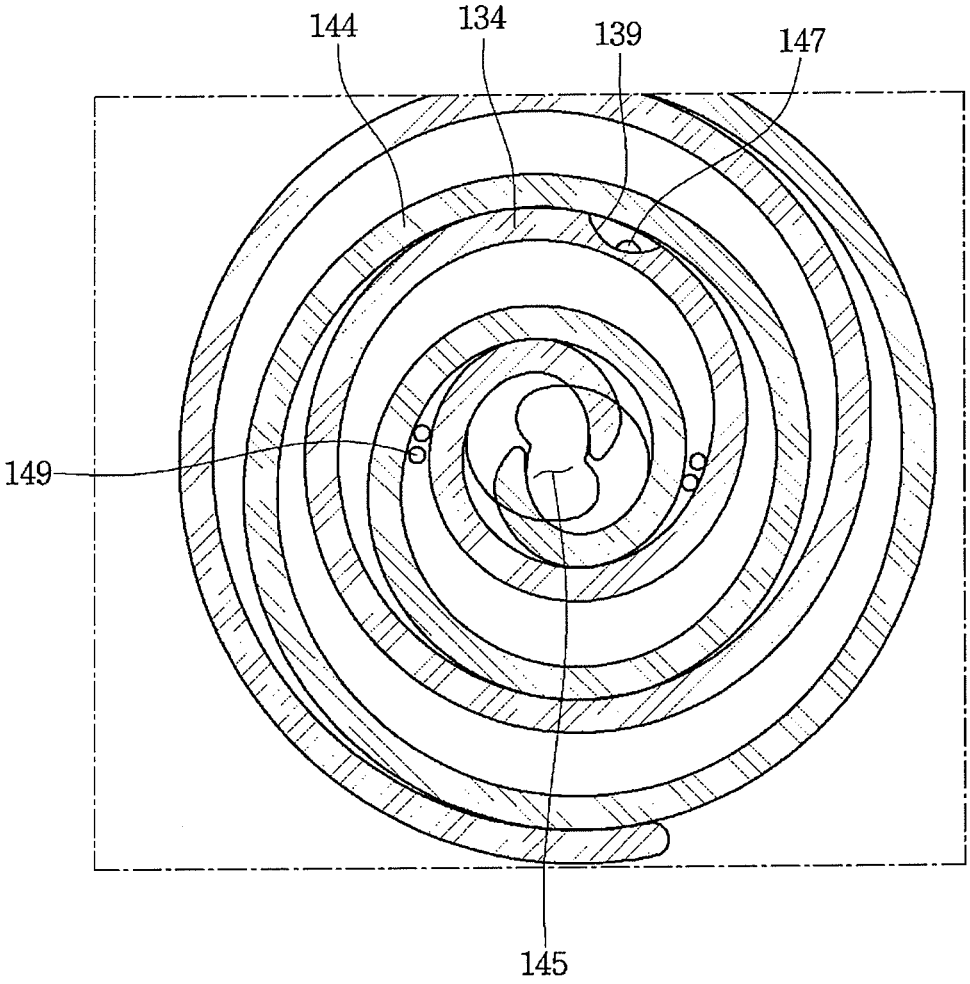
Figure 10C:
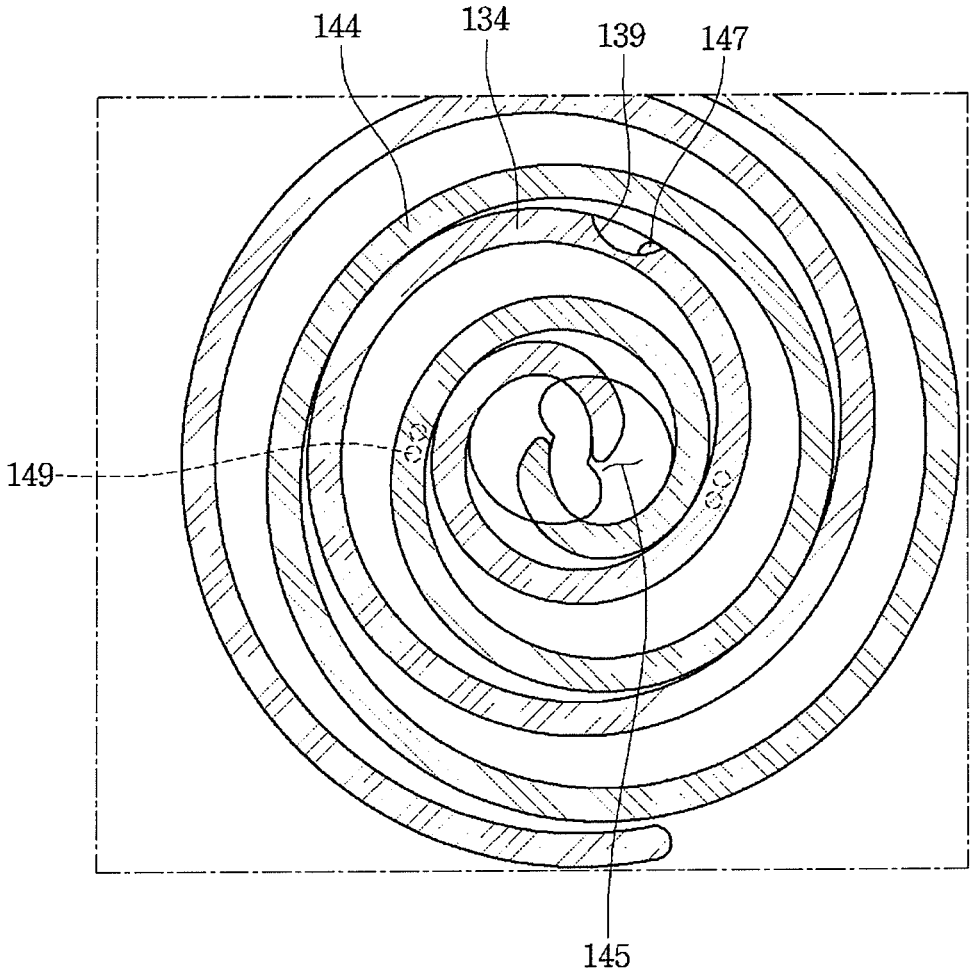
Figure 11A:
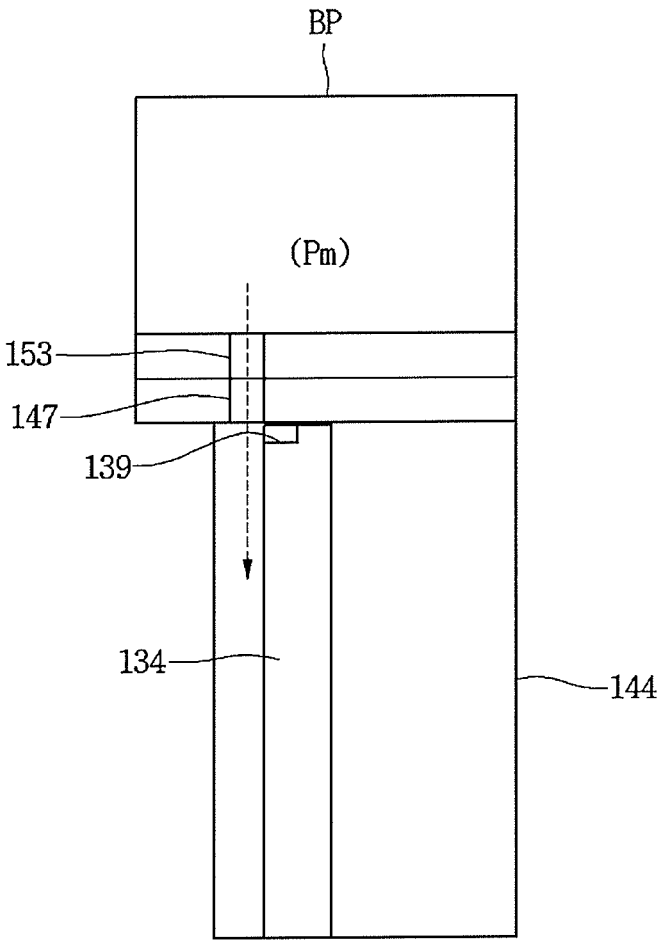
FIGS. 11A and 11B are schematic views of a state in which the intermediate pressure refrigerant of the back pressure chamber is discharged into the compression chamber through the discharge guide according to a position of the orbiting scroll.
Figure 11B:
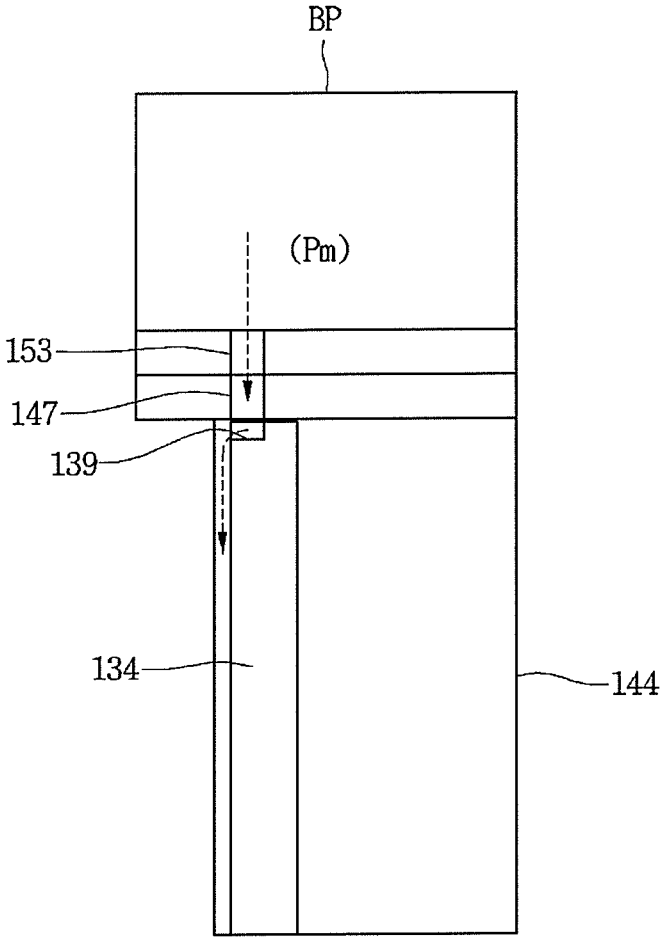

FIG. 8 is a view illustrating a portion of an orbiting scroll according to an embodiment. FIG. 9 is a cross-sectional view illustrating a coupled state of the fixed scroll and the orbiting scroll according to an embodiment. FIGS. 10A to 10C are views illustrating relative positions of an intermediate pressure discharge hole of the fixed scroll and a discharge guide of the orbiting scroll while the orbiting scroll revolves. FIGS. 11A and 11B are schematic views of a state in which the intermediate pressure refrigerant of the back pressure chamber is discharged into the compression chamber through the discharge guide according to a position of the orbiting scroll.

Referring to FIGS. 8 and 9, the orbiting scroll 130 according to an embodiment may include a discharge guide 139 to guide the refrigerant flowing into the intermediate pressure discharge hole 147, so that the refrigerant may be introduced into a space (region) having a pressure which is less than a pressure of the back pressure chamber BP. In detail, when the operation of the scroll compressor 100 stops, the compression chamber defined by the orbiting wrap 134 and the fixed wrap 144 vanishes, and thus, the refrigerant flows into the space (region) between the orbiting wrap 134 and the fixed wrap 144. The space (region) may have a pressure less than a pressure of the back pressure chamber BP. The space (region) may be referred to as a "wrap space".

The discharge guide 139 may be recessed from an end surface of the orbiting wrap 134 of the orbiting scroll 130. Thus, the discharge guide 139 may be referred to as a "recess". The end surface of the orbiting wrap 134 may be understood as a surface of the orbiting wrap 134 that faces the second head plate 143 of the fixed scroll 140, or a surface of the orbiting wrap 134 that contacts the second head plate 143.

A width of the end surface of the orbiting wrap 134, that is, a thickness of the orbiting wrap 134 may be greater than a width of the intermediate pressure discharge hole 147. Also, the discharge guide 139 may be recessed by a width and depth, which may be set from the end surface of the orbiting wrap 134. This will be described hereinbelow.

While the orbiting scroll 130 revolves, the orbiting wrap 134 may be disposed directly below the intermediate pressure discharge hole 147 or be disposed to be spaced horizontally from a lower end of the intermediate pressure discharge hole 147 to open the intermediate pressure discharge hole 147. If the discharge guide 139 is not provided, when the orbiting wrap 134 is disposed directly below the intermediate pressure discharge hole 147 (in FIG. 9), the orbiting wrap 134 may shield the intermediate pressure discharge hole 147. On the other hand, when the orbiting wrap 134 moves horizontally by a predetermined distance, at least a portion of the intermediate pressure discharge hole 147 may be opened. Also, while the scroll compressor 100 operates, when the intermediate pressure discharge hole 147 is opened, the intermediate pressure refrigerant of the compression chamber may be introduced into the back pressure chamber BP through the intermediate pressure discharge hole 147. On the other hand, in a state in which the scroll compressor 100 stops, when the orbiting wrap 134 is disposed directly below the intermediate pressure discharge hole 147 to block the intermediate pressure discharge hole 147, the refrigerant of the back pressure chamber BP may not be introduced into the wrap space through the intermediate pressure discharge hole 147. As a result, the equilibrium pressure may not be maintained, and thus, quick re-operation of the compressor may be limited or prevented.

Thus, embodiments disclosed herein may include a feature in which the discharge guide 139 is disposed in the orbiting wrap 134 to prevent the intermediate pressure discharge hole 147 from being completely covered or shielded, and thus, even though the orbiting wrap 134 is disposed directly below the intermediate pressure discharge hole 147, the intermediate pressure discharge hole 147 and the compression chamber (when the compressor operates) or the intermediate pressure discharge hole 147 and the wrap space (when the compressor stops) may communicate with each other.

Referring to FIGS. 10A to 10C, the plurality of compression chambers may be formed while the orbiting scroll 130 revolves, and then, the plurality of compression chambers may move toward the discharge hole 145 while being reduced in volume. With this process, the orbiting wrap 134 of the orbiting scroll 130 may selectively open the bypass hole 149. For example, when the orbiting wrap 134 opens the bypass hole 149, the refrigerant of the compression chamber that communicates with the bypass hole 149 may flow into the bypass hole 149 to bypass the discharge hole 145. On the other hand, when the orbiting wrap 134 covers the bypass hole 149, the flow of the refrigerant of the compression chamber into the bypass hole 149 may be limited.

The back pressure chamber BP and the intermediate pressure discharge hole 147 may always communicate with the compression chamber via the discharge guide 139. That is, the discharge guide 139 may be disposed on an end of the orbiting wrap 134 at a position at which the back pressure chamber BP and the intermediate pressure discharge hole 147 always communicate with the compression chamber.

In summary, even though the orbiting wrap 134 is disposed directly below the intermediate pressure discharge hole 147 while the orbiting wrap 134 revolves, the lower end of the intermediate pressure discharge hole 147 and the end surface of the orbiting wrap 134 may be spaced apart from each other by the recessed discharge guide 139. Thus, when the compressor operates, the refrigerant of the compression chamber may be introduced into the back pressure chamber BP through the intermediate pressure discharge hole 147. Also, when the compressor stops, the refrigerant of the back pressure chamber BP may be introduced into the wrap space through the intermediate pressure discharge hole 147.

In detail, FIGS. 10A to 10C illustrate the state in which the orbiting wrap 134 is disposed directly below the intermediate pressure discharge hole 147 while the orbiting wrap 134 revolves, that is, the state in which the end surface of the orbiting wrap 134 is disposed to block the intermediate pressure discharge hole 147 if the discharge guide 139 is not provided. Even though the orbiting wrap 134 is disposed as illustrated in FIGS. 10A to 10C, the intermediate pressure discharge hole 147 may communicate with the compression chamber through the discharge guide 139. Thus, as illustrated in FIG. 11B, the refrigerant of the back pressure chamber BP having an intermediate pressure Pm may be introduced into the wrap space between the orbiting wrap 134 and the fixed wrap 144 via the intermediate pressure discharge hole 147 and the discharge guide 139.

If the orbiting wrap 134 is disposed at a position that is not illustrated in FIGS. 10A to 100, at least a portion of the intermediate pressure discharge hole 147 may be opened. That is, the orbiting wrap 134 may be in the state in which the orbiting wrap 134 moves horizontally to open the at least a portion of a lower end of the intermediate pressure discharge hole 147. Thus, as illustrated in FIG. 11A, as the intermediate pressure discharge hole 147 is opened, the refrigerant of the back pressure chamber BP having the intermediate pressure Pm may be introduced into the wrap space through the intermediate pressure discharge hole 147.

Figure 12:
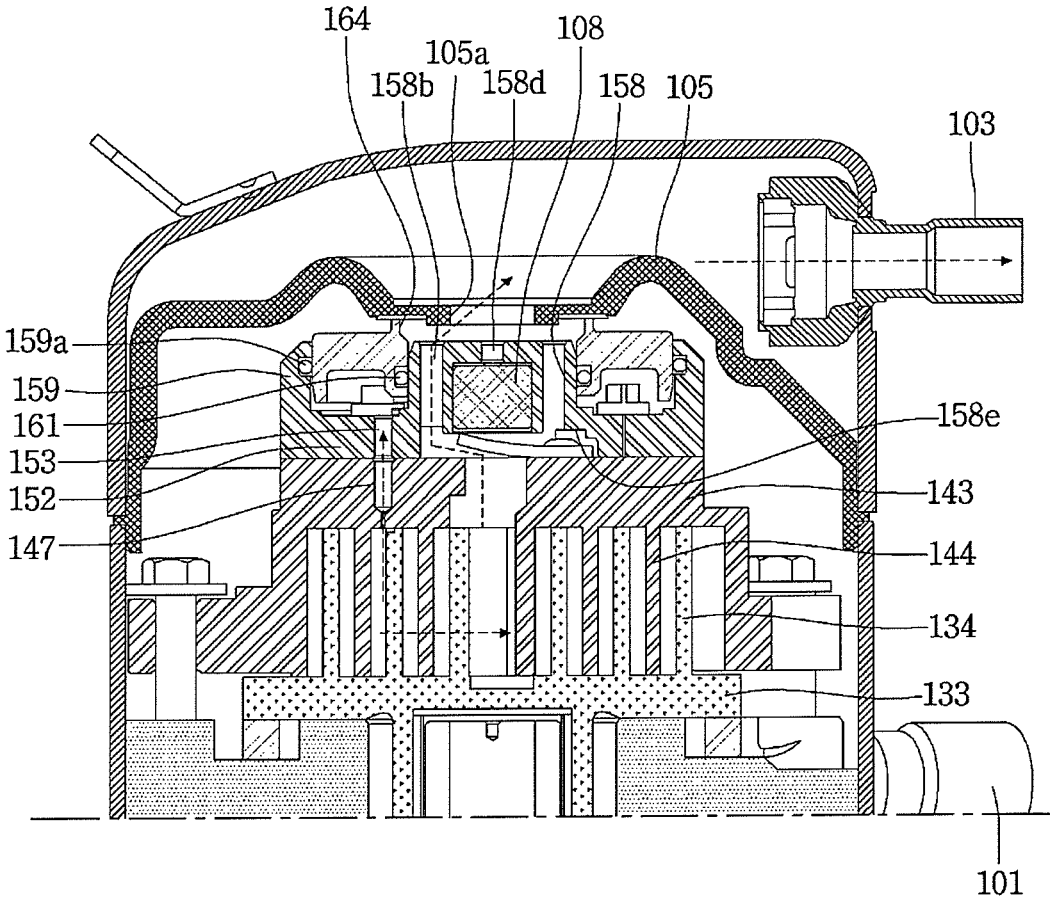
FIG. 12 is a cross-sectional view illustrating a flow of the refrigerant when the scroll compressor operates according to an embodiment.
Figure 13:
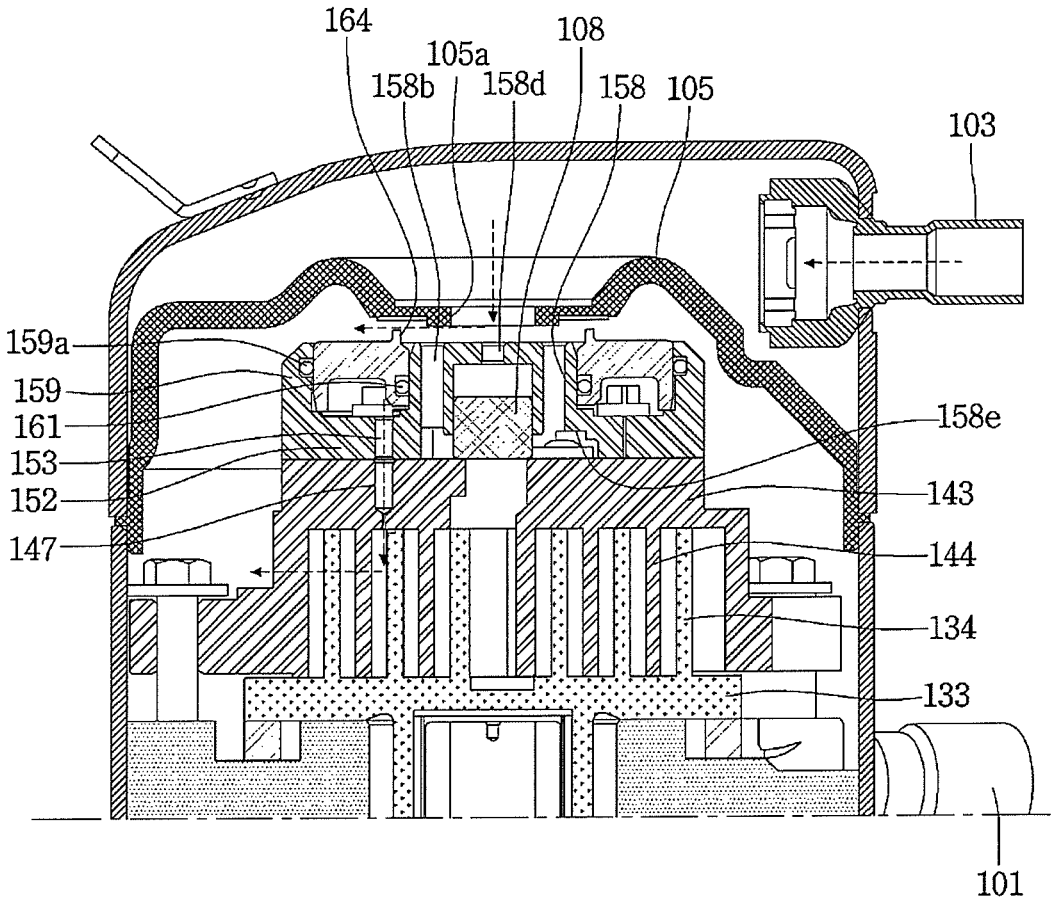
FIG. 13 is a cross-sectional view illustrating a flow of the refrigerant when the scroll compressor stops according to an embodiment.

FIG. 12 is a cross-sectional view illustrating a flow of the refrigerant when the scroll compressor operates according to an embodiment. FIG. 13 is a cross-sectional view illustrating a flow of the refrigerant when the scroll compressor stops according to an embodiment.

Referring to FIGS. 12 and 13, for each of when the scroll compressor operates or stops, the effects according to this embodiment, that is, a flow of the refrigerant will be described. Referring to FIG. 12, in a case in which the scroll compressor 100 according to an embodiment operates, when power is applied to the stator 112, the rotational shaft 116 rotates by the effect of the stator 112 and the rotor 114. As the rotational shaft 116 rotates, the orbiting scroll 130 coupled to the rotational shaft 116 revolves with respect to the fixed scroll 140. As a result, the plurality of compression chambers formed between the fixed wrap 144 and the orbiting wrap 134 may move toward the discharge hole 145 to compress the refrigerant.

The fixed wrap 144 and the orbiting wrap 134 may be closely attached to each other in a radial direction, that is, a direction perpendicular to the rotational shaft 116, to form the plurality of compression chambers. The plurality of compression chambers may be sealed by adhesion between the wraps 134 and 144 to prevent the refrigerant from leaking in the radial direction.

While the refrigerant is compressed, at least a portion of the refrigerant within the compression chamber having the intermediate pressure may be introduced into the back pressure chamber BP through the intermediate pressure discharge hole 147 of the fixed scroll 140 and the intermediate pressure suction hole 153 of the back pressure plate 150. Even though the orbiting wrap 134 of the orbiting scroll 130 is disposed directly below the intermediate pressure discharge hole 147 to contact the intermediate pressure discharge hole 147, as the intermediate pressure discharge hole 147 and the compression chamber communicate with each other by the discharge guide 139, the refrigerant may flow into the intermediate pressure discharge hole 147. Also, as the intermediate pressure discharge hole 147 and the back pressure chamber BP communicate with each other, the refrigerant flowing through the intermediate pressure discharge hole 147 may be easily introduced into the back pressure chamber BP.

Thus, the back pressure chamber BP may have the intermediate pressure between the suction pressure and the discharge pressure. As described above, as the back pressure chamber BP has the intermediate pressure, a downward force may be applied to the back pressure plate 150, and an upward force may be applied to the floating plate 160.

As the back pressure plate 150 is coupled to the fixed scroll 140, the intermediate pressure of the back pressure chamber BP may have an influence on the fixed scroll 140. However, as the fixed scroll 140 is in contact with the first head plate 133 of the orbiting scroll 130, the floating plate 160 may move upward. As the floating plate 160 moves upward, the rib 164 of the floating plate 160 may move upward until the rib 164 contacts the bottom surface of the discharge cover 105.

Also, the pressure of the back pressure chamber BP may compress the fixed scroll 140 toward the orbiting scroll 130 to prevent the refrigerant from leaking between the orbiting scroll 130 and the fixed scroll 140. The fixed wrap 144 and first head plate 133 and the orbiting wrap 134 and the second head plate 143 may be closely attached to each other in an axis or axial direction, that is, a direction parallel to the rotational shaft 116 to form the plurality of compression chambers. The plurality of compression chambers may be sealed by adhesion between the wraps 134 and 144 and the first and second head plates 133 and 143 to prevent the refrigerant from leaking in the axial direction. Also, the refrigerant of the compression chamber moving toward the discharge hole 145 may flow toward the intermediate discharge hole 158*b* of the back pressure plate 150 through the discharge hole 145, and then, may be discharged to the outside of the discharge outlet 103 via the discharge hole 105*a* of the discharge cover 105.

The discharge valve 108 may be in a state in which the discharge valve 108 is moved upward along the moving guide 158*c* by the refrigerant having the discharge pressure, which is discharged from the discharge hole 145. Thus, the discharge hole 145 may be opened. That is, as the pressure of the discharge hole 145 is greater than the pressure of the discharge space D, the discharge valve 108 may move upward.

As described above, as the rib 164 contacts the bottom surface of the discharge cover 105 to block the passage between the floating plate 160 and the discharge cover 105, the refrigerant passing through the intermediate discharge hole 158*b* may not flow toward the suction space S through the passage, but rather, passes through the discharge hole 105*a* of the discharge cover 105.

Although not shown, while the refrigerant is compressed in the plurality of compression chambers, the compression chamber that communicates with the bypass hole 149 may have the intermediate pressure. As the intermediate pressure is less than the discharge pressure, the bypass valve 124 may be in a closed state. However, if the suction pressure increases due to changes in operation conditions, the intermediate pressure which is greater by about 1.5 times than the suction pressure may be greater than the discharge pressure. In the case of the scroll compressor, as a compression ratio is fixed, the discharge pressure may be obtained by multiplying the suction pressure by the compression ratio. Thus, if the suction pressure exceeds an optimal range, the discharge pressure may excessively increase, causing overload. Thus, even before the refrigerant of the compression chamber having the intermediate pressure reaches the discharge hole 145, if the intermediate pressure is excessive, the refrigerant has to be previously discharged to solve the overload.

In this embodiment, if the intermediate pressure increases and then is greater than the discharge pressure, the valve body 124*c* may ascend to open the bypass hole 149. Also, the refrigerant within the intermediate pressure chamber may flow into the discharge space D through the bypass hole 149. The refrigerant discharged through the bypass hole 149 may be mixed with the refrigerant discharged from the discharge hole 145 to flow into the discharge space D. Due to the above-described operation, excessive increase of the pressure of the intermediate pressure chamber may be prevented.

In the case of the compressor, as a range of operation conditions of a system to be adopted for the compressor is preset or predetermined, it may be previously seen how wide is a range of suction and discharge pressures. Also, a time point at which the compression chamber having the intermediate pressure is excessive may be predicted on the basis of the above-described values. Thus, the bypass hole may be formed at a position corresponding to the time point to solve the overload issue.

In this embodiment, as the back pressure chamber assembly 150 and 160 is separable from the fixed scroll 140, the bypass hole 149 may be defined at a predetermined position on the second head plate 143 of the fixed scroll 140, and then, the bypass valve 124 may be disposed to effectively prevent the overload from occurring.

Next, referring to FIG. 13, in the case of the scroll compressor 100 according to an embodiment, supply of power applied to the stator 112 may stop. Thus, the rotation of the rotational shaft 116 and revolution of the orbiting scroll 130 may stop, stopping compression of the refrigerant.

When compression of the refrigerant stops, a force that closely attaches the fixed wrap 114 to the orbiting warp 134, that is, a force that closely attaches the fixed wrap 114 to the orbiting wrap 134 in the radial direction may be relieved or released. Thus, the sealed compression chamber formed by the fixed wrap 144 and the orbiting wrap 134 may vanish.

In detail, the discharge hole-side refrigerant having a relatively high pressure and the refrigerant within the compression chamber may flow toward the suction space S. A pressure of the wrap space formed by the fixed wrap 144 and the orbiting wrap 134 may reach a predetermined pressure (equilibrium pressure). Also, as the relative pressure of the discharge space D temporarily increases, the discharge valve 108 may move downward to block the discharge hole 145. Thus, it may prevent the refrigerant of the discharge space D from flowing backward into the wrap space through the intermediate discharge hole 158*b* and the discharge hole 145 and reversing the fixed scroll 140.

As the scroll compressor 100 stops, the orbiting wrap 134 may stop at a predetermined position. Even though the orbiting wrap 134 is disposed on or at a position at which the intermediate pressure discharge hole 147 is opened (see FIG. 11A), as well as, the orbiting wrap 134 is disposed on or at a position at which the intermediate pressure discharge hole 147 is closed (see FIG. 11B), the refrigerant of the back pressure chamber BP may be bypassed to the wrap space through the discharge guide 139. That is, the refrigerant of the back pressure chamber BP may be introduced into the wrap space through the intermediate pressure suction hole 153 and the intermediate pressure discharge hole 147 to flow into the suction space S. Also, the back pressure chamber BP may be maintained at the equilibrium pressure by the flow of the refrigerant.

As the back pressure chamber BP is maintained at the equilibrium pressure, the floating plate 160 may move downward, and thus, the rib 164 may be spaced apart from the bottom surface of the discharge cover 105. Thus, the passage between the floating plate 160 and the discharge cover 105 may be opened. As a result, the refrigerant of the discharge cover 105 or the discharge space D may flow toward the suction space S through the passage. The pressure of the discharge cover 105 or the discharge space D may be maintained at the equilibrium pressure by the flow of the refrigerant.

As described above, as the refrigerant of the back pressure chamber BP is introduced into the wrap space through the discharge guide 139 of the orbiting wrap 134, the back pressure chamber BP may be maintained at the equilibrium pressure. Also, the rib 164 may be spaced apart from the discharge cover 105 to open the passage of the refrigerant. As a result, as the pressure of the discharge cover 105 or the discharge space D may be maintained at the equilibrium pressure, the compressor 100 may quickly re-operate when the compressor 100 is driven.

If the refrigerant of the back pressure chamber BP is not introduced into the wrap space to allow the back pressure chamber BP to be maintained to or at the intermediate pressure, and also, the rib 164 is maintained in contact with the discharge cover 105, and thus, the pressure of the discharge cover 105 and the discharge space D is not maintained at the equilibrium pressure, the fixed scroll 140 and the orbiting scroll 130 may be closely attached to each other at an excessive pressure. As a result, it may be difficult to quickly drive the compressor again. However, this embodiment may solve the above-described limitation.

A check valve (not shown) may be disposed in the discharge outlet 103. Thus, when the operation of the scroll compressor 100 stops, the check valve may be closed to prevent the refrigerant outside the scroll compressor 100 from being introduced into the casing 110 through the discharge outlet 103.

Figure 14:
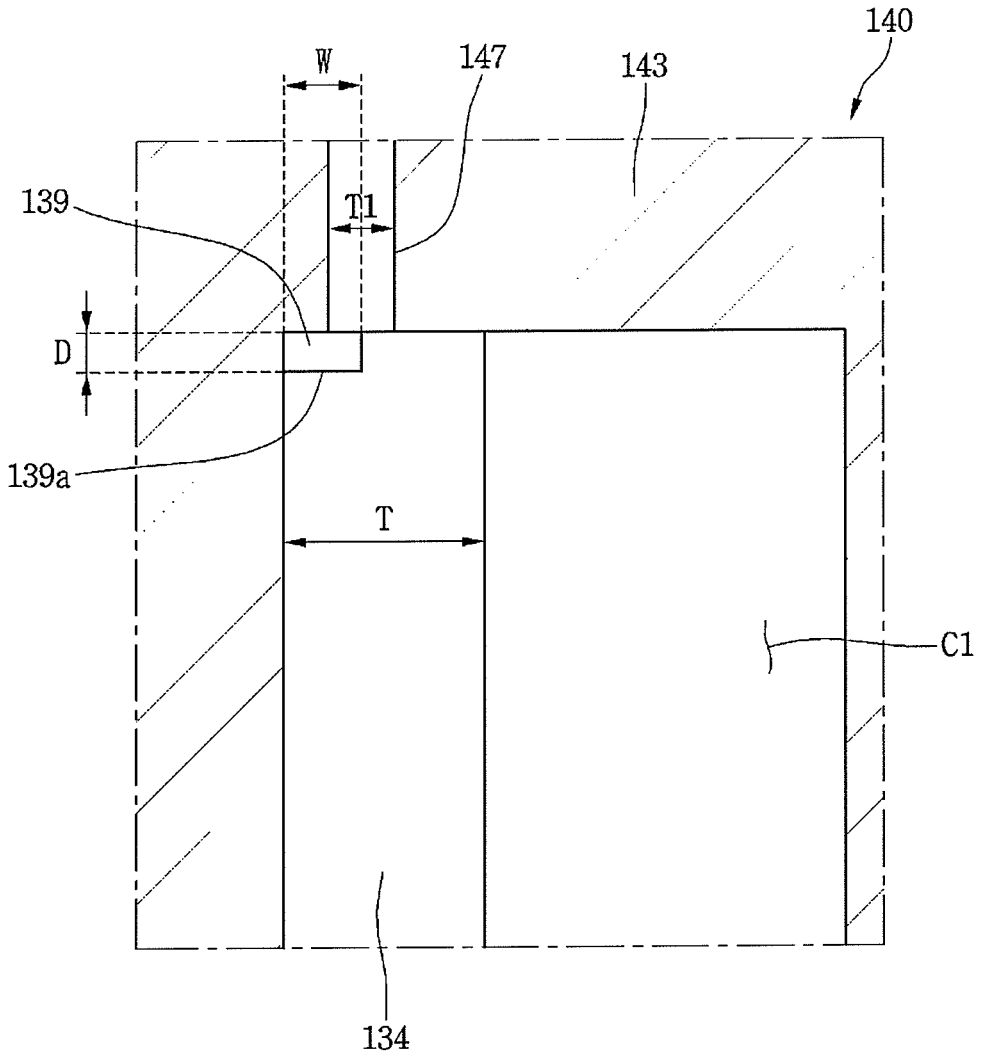
FIG. 14 is a cross-sectional view illustrating the discharge guide of the orbiting scroll according to an embodiment.
Figure 15A:
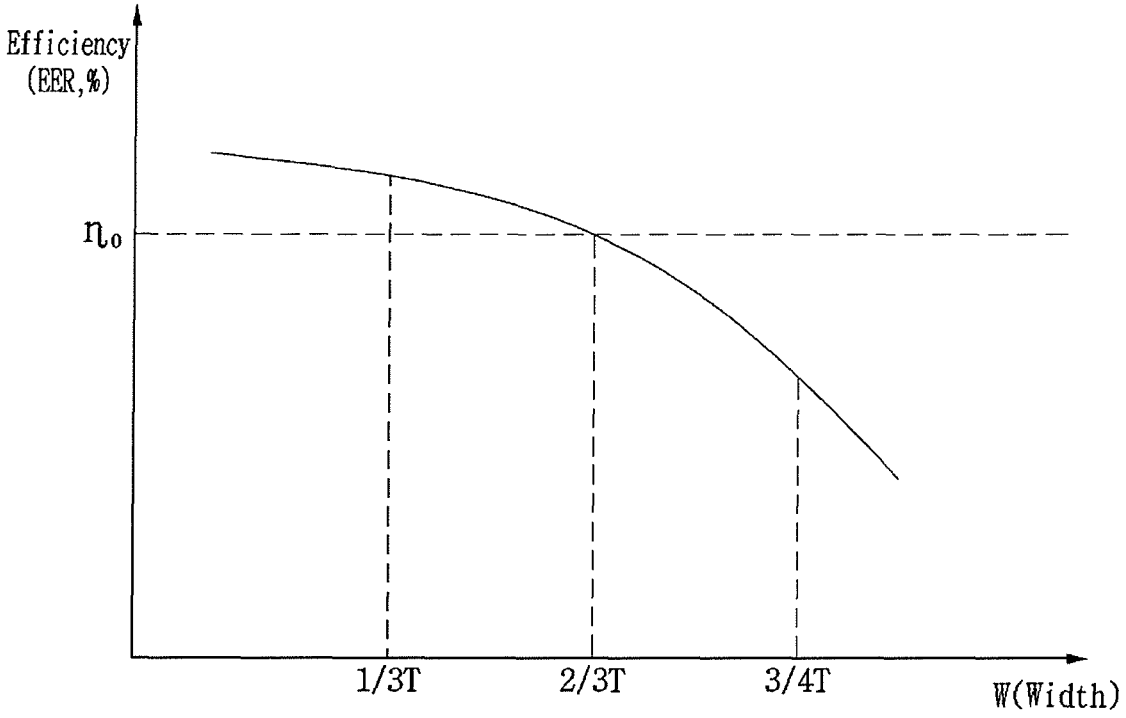
FIG. 15A and 15B are graphs illustrating a variation in efficiency of the compressor according to a size of the discharge guide.
Figure 15B:
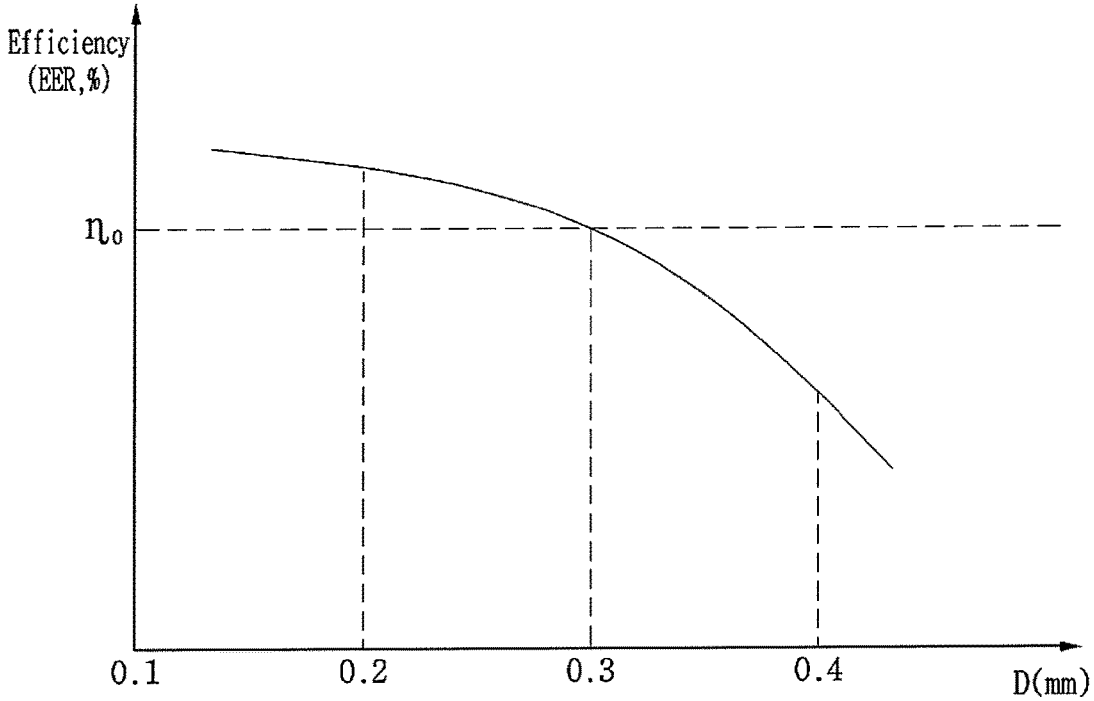

FIG. 14 is a cross-sectional view illustrating the discharge guide of the orbiting scroll according to an embodiment. FIG. 15A and 15B are graphs illustrating a variation in efficiency of the compressor according to a size of the discharge guide.

Referring to FIG. 14, in the orbiting wrap 134 according to an embodiment, the discharge guide 139 to open the intermediate pressure discharge hole 147 to guide the refrigerant so that the refrigerant is discharged from the intermediate pressure discharge hole 147 to a wrap space C1 may be defined to have a predetermined width W and depth D.

The width W may be understood as a length in a radial direction of the discharge guide 139, and the depth D may be understood as a distance from an end of the orbiting wrap 134 to the recessed surface of the discharge guide 139. The wrap space C1 may be understood as a space between the orbiting wrap 134 and the fixed wrap 144 in a state in which the compression chamber formed by closely attaching the orbiting wrap 134 to the fixed wrap 144 vanishes after the scroll compressor 100 stops.

The orbiting wrap 134 may have a thickness T greater than a size or thickness T1 of the intermediate pressure discharge hole 147. The size or thickness T1 of the intermediate pressure discharge hole 147 may be a diameter when the intermediate pressure discharge hole 147 has a circular cross-section. Also, when the intermediate pressure discharge hole 147 has an oval or polygonal shape, the size or thickness T1 of the intermediate pressure discharge hole 147 may be the largest width defined in a horizontal (radial) direction.

The discharge guide 139 may have a recessed surface 139*a* formed by being recessed to have the width W and depth D. A horizontal length of the recessed surface 139*a* may correspond to the width W, and a vertical length of the recessed surface 139*a* may correspond to the depth D.

Although the recessed surface 139*a* is bent in a horizontal or vertical direction in FIG. 14, embodiments are not limited thereto. For example, the recessed surface 139*a* may include a curved portion or have a straight-line shape without being bent.

If a width W or depth D of the discharge guide 139 is too large, the refrigerant may leak from the compression chamber having a relatively high pressure to the compression chamber having a relatively low pressure among the plurality of compression chambers when the compressor 100 operates, and thus, the compressor may be deteriorated in operation efficiency. Thus, this embodiment proposes a dimension with respect to the width W or depth D of the discharge guide 139 to allow the refrigerant to smoothly flow from the back pressure chamber BP to the wrap space C1 without deteriorating the operation efficiency of the compressor. FIG. 15 illustrates a graph obtained by repetitive experiments.

Referring to the graph of FIG. 15A, the horizontal axis represents a width W of the discharge guide 139, and the vertical axis represents an energy efficiency ratio (EER) of the compressor. The discharge guide 139 may have a depth D corresponding to a predetermined value (constant value).

In detail, the more the width W of the discharge guide 139 increases, the more a leaking amount of refrigerant while the refrigerant is compressed, that is, a refrigerant leaking amount in an axial direction increases. Thus, the EER of the compressor may be reduced.

To maintain the EET of the scroll compressor 100 to a value greater than a required efficiency ratio $\eta o$, the discharge guide 139 may have a width W less than 2T/3. When the width W of the discharge guide 139 is greater than 2T/3, for example, is 3T/4, it may be seen that the EER of the compressor is reduced by about 30% or more in comparison with the required efficiency ratio $\eta o$.

Next, referring to the graph of FIG. 15B, the horizontal axis represents a depth D of the discharge guide 139, and the vertical axis represents the energy efficiency ratio (EER) of the compressor. The discharge guide 139 may have a width W corresponding to a predetermined value (constant value).

In detail, the more the depth D of the discharge guide 139 increases, the more a leaking amount of refrigerant while the refrigerant is compressed, that is, a refrigerant leaking amount in a radial direction increases. Thus, the EER of the compressor may be reduced.

To maintain the EET of the scroll compressor 100 to a value greater than a required efficiency ratio $\eta o$, the discharge guide 139 may have a depth D less than about 0.3 mm. When the depth D of the discharge guide 139 is greater than about 0.3 mm, for example, is about 0.4 mm, it may be seen that the EER of the compressor is reduced by about 30% or more in comparison with the required efficiency ratio $\eta o$.

In summary, the discharge guide 139 may have a depth D of about 0.3 mm or less. Also, the discharge guide 139 may have a width W less than ⅔ times the thickness T of the orbiting wrap 134.

Figure 16:
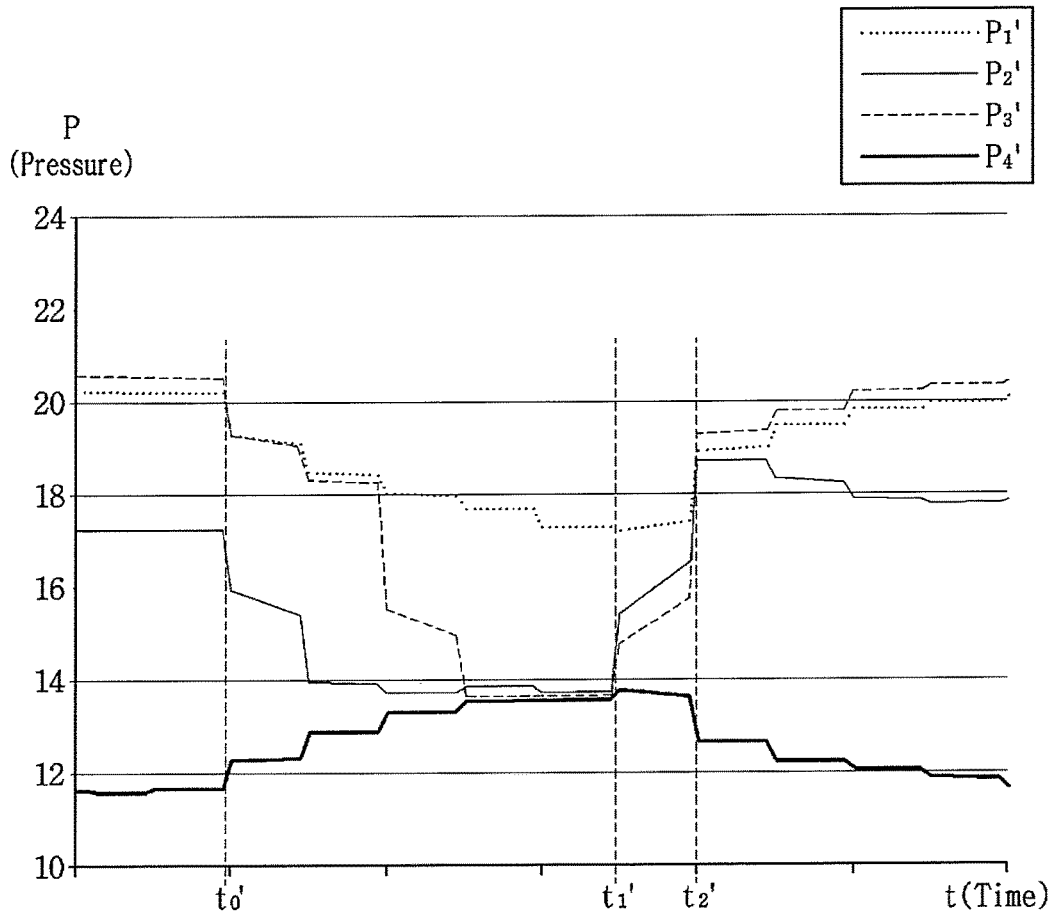
FIG. 16 is a graph illustrating a variation in inner pressure of the compressor when the scroll compressor stops and then re-operates according to an embodiment.

FIG. 16 is a graph illustrating a variation in inner pressure of the compressor when the scroll compressor stops and then re-operates according to an embodiment. Referring to FIG. 16, when the scroll compressor 100 according to this embodiment stops at a time t0', each of P1' (a pressure of the refrigerant discharged from the compressor), P2' (an intermediate pressure of the back pressure chamber), P3' (a pressure of the discharge cover-side refrigerant), and P4' (a pressure of the suction-side refrigerant) may be gradually converged to an equilibrium pressure.

Also, when power is applied to the stator 112 at a time t1' to allow an operation of the compressor to start, the compressor may re-operate at a time t2' after a short time □t elapses. As a result, a difference in pressure for each position within the compressor may occur. That is, actual compression of the refrigerant may be quickly performed.

Figure 17:
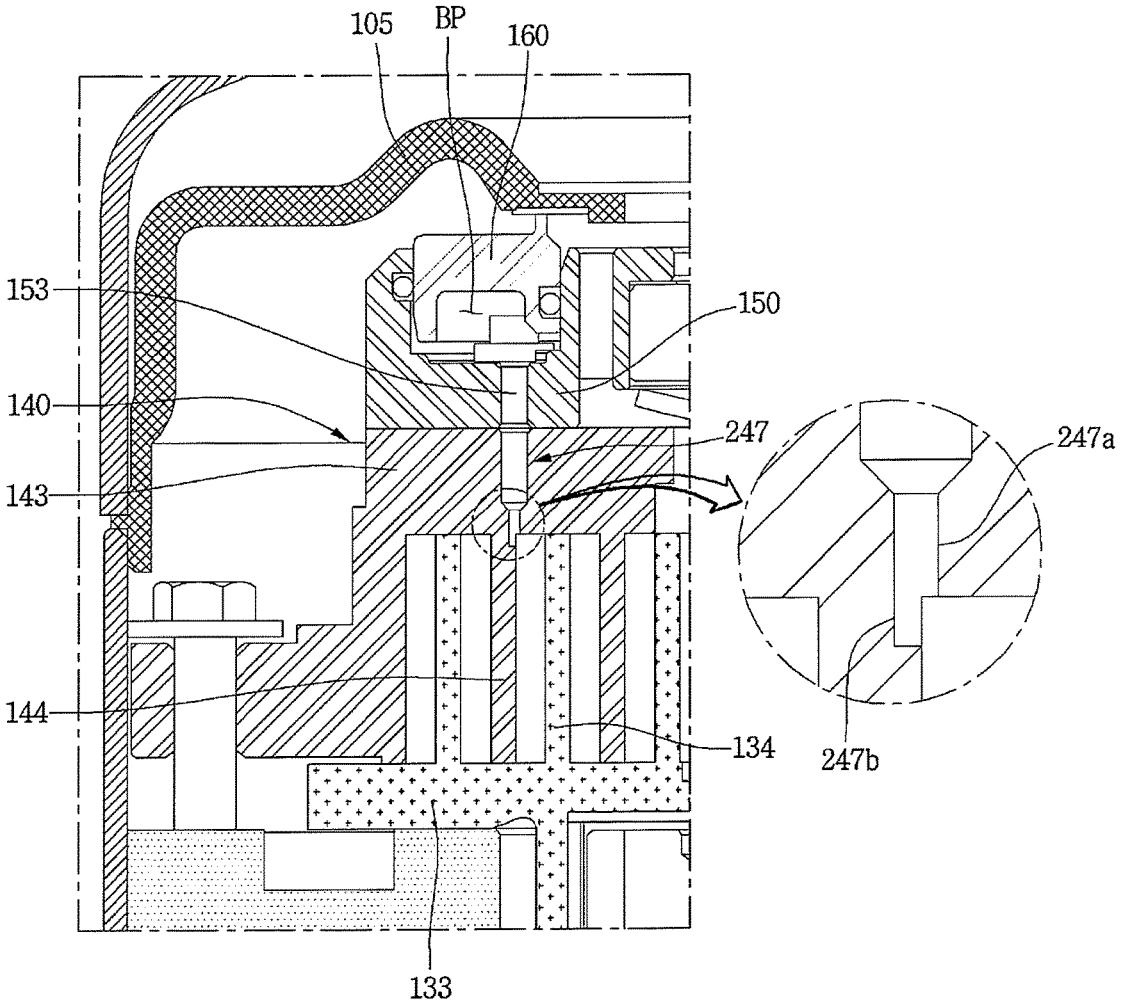
FIG. 17 is a cross-sectional view illustrating a portion of a scroll compressor according to another embodiment.

FIG. 17 is a cross-sectional view illustrating a portion of a scroll compressor according to another embodiment. Referring to FIG. 17, scroll compressor 100 according to this embodiment may include an intermediate pressure discharge hole 247 that defines a discharge guide defined in fixed scroll 140 to guide a flow of a refrigerant into a compression chamber.

In detail, the intermediate pressure discharge hole 247 may include a first guide 247*a* defined in second head plate 143 of the fixed scroll 140, and a second guide defined in fixed wrap 144 of the fixed scroll 140. Each of the first and second guides 247*a* and 247*b* may form at least a portion of the intermediate pressure discharge hole 247.

Unlike the intermediate discharge hole 147 according to the previous embodiment, which is defined in the second head plate 143 of the fixed scroll 140, the intermediate pressure discharge hole 247 according to this embodiment may extend into the fixed wrap 144 from the second head plate 143 of the fixed scroll 140. That is, the intermediate pressure discharge hole 247 may be defined in the fixed wrap 144.

As a result, as the intermediate pressure hole 247 functions as a "discharge guide" and is defined over a plurality of portions from the second head plate 143 to the fixed wrap 144, that is, as an opened portion of the intermediate pressure discharge hole 247 extends in an "axial direction" parallel to rotational shaft 116 and a "radial direction" perpendicular to the axial direction, the intermediate pressure discharge hole 247 may easily communicate with the compression chamber.

More particularly, in a state in which the scroll compressor 100 stops, adhesion between the fixed scroll 140 and the orbiting scroll in the radial direction may weaken to form a wrap space between the orbiting wrap 134 and the fixed wrap 144. Thus, the refrigerant may be easily discharged from the intermediate pressure discharge hole 247.

In summary, as the discharge guide according to this embodiment is defined in the intermediate pressure discharge hole 247, when the compressor stops, back pressure chamber BP may communicate with the wrap space regardless of a position of the orbiting wrap 134. Thus, the compressor may quickly re-operate.

Further, while the scroll compressor 100 operates to compress the refrigerant, the intermediate pressure discharge hole 247 may communicate with the compression chamber through the first and second guides 247*a* and 247*b* regardless of a position of the orbiting wrap 134. Thus, the refrigerant of the compression chamber may be easily bypassed to the back pressure chamber BP via the intermediate pressure discharge hole 247.

According to embodiments, the discharge guide may be disposed on or at a side of the fixed scroll or the orbiting scroll. Thus, when the compressor stops, as the intermediate pressure refrigerant existing in the back pressure chamber may be discharged toward the compression chamber through the discharge guide, the equilibrium pressure within the compressor may be maintained, and thus, the compressor may quickly re-operate.

Further, a portion of the wrap of the orbiting scroll or the fixed scroll may be recessed to form the discharge guide. While the orbiting scroll revolves, the back pressure chamber, the discharge guide, and the compression chamber may be disposed to always communicate with each other, thereby preventing the warp of the orbiting scroll from sealing the back pressure chamber.

Furthermore, as the discharge guide is limited to have an optimal width or depth, discharge of the intermediate pressure refrigerant of the back pressure chamber may be guided. In addition, it may prevent the refrigerant in one compression chamber (pocket) from leaking into the other compression chamber (pocket) through the discharge guide.

Embodiments disclosed herein provide a scroll compressor that is capable of quickly re-operating or starting operation again by discharging an intermediate pressure refrigerant of a back pressure chamber when the compressor stops.

Embodiments disclosed herein provide a scroll compressor that may include a casing including a rotational shaft; a discharge cover fixed at an inside of the casing to partition the inside of the casing into a suction space and discharge space; a first scroll rotated by the rotational shaft to perform an orbiting motion; a second scroll disposed on or at a side of the first scroll to define a plurality of compression chambers together with the first scroll, the second scroll having an intermediate pressure discharge hole that communicates with a compression chamber having an intermediate pressure among the plurality of compression chambers; a back pressure plate coupled to the second scroll, the back pressure plate having an intermediate pressure suction hole that communicates with the intermediate pressure discharge hole; a floating plate movably disposed on or at a side of the back pressure plate to define a back pressure chamber together with the back pressure plate; and a discharge guide defined in the first scroll or the second scroll to guide discharge of a refrigerant within the back pressure chamber. While the refrigerant is compressed in the plurality of compression chambers, the back pressure chamber may communicate with the compression chamber through the discharge guide. When the compression of the refrigerant stops, the refrigerant of the back pressure chamber may be discharged into a region having a pressure less than a pressure of the back pressure chamber through the discharge guide.

The first scroll may include a first head plate coupled to the rotational shaft, and a first wrap that extends from the first head plate in one direction, and the discharge guide may include a recessed part or recess that is defined by recessing at least a portion of the first wrap. The second scroll may include a second head plate coupled to the back pressure plate, and a second wrap that extends from the second head plate toward the first head plate, and the recessed part may be defined in one surface of the first wrap, which faces the second head plate. The recessed part may have a width (W) of about 0.3 mm or less. The recessed part may have a depth (D) less than ⅔ times a thickness (T) of the first wrap.

The scroll compressor may further include a discharge hole defined in the second scroll, the discharge hole having a discharge pressure that is compressed in the plurality of compression chambers, and an intermediate discharge hole defined in the back pressure plate to communicate with the discharge hole, thereby guiding the refrigerant toward the discharge cover. The scroll compressor may further include a discharge valve device or discharge valve movably disposed on or at a side of the discharge hole. The discharge valve device may open the discharge hole while the refrigerant is compressed and close the discharge hole when the compression of the refrigerant stops.

The floating plate may further include a rib that protrudes toward the discharge cover. While the refrigerant is compressed, the rib may contact the discharge cover, and when the compression of the refrigerant stops, the rib may be spaced away from the discharge cover.

The scroll compressor may further include a bypass hole that passes through at least a portion of the second scroll to communicate with one compression chamber of the plurality of compression chambers, and a bypass valve that selectively opens the bypass hole.

The discharge guide may define at least a portion of the intermediate pressure discharge hole. The second scroll may include a second head plate coupled to the back pressure plate, and a second wrap that extends from the second head plate. The discharge guide may be defined in the second wrap.

Embodiments disclosed herein further provide a scroll compressor that include a casing; a discharge cover fixed at an inside of the casing to partition the inside of the casing into a suction space and a discharge space; a main frame disposed to be spaced apart from the discharge cover; a first scroll disposed on or at a side of the main frame to perform an orbiting motion; a second scroll disposed on or at a side of the first scroll to define a plurality of compression chambers together with the first scroll, the second scroll having a discharge hole through which a compressed refrigerant may be discharged; a back pressure plate coupled to the second scroll, the back pressure plate including a discharge valve device or discharge valve that selectively opens the discharge hole; a floating plate movably disposed on or at a side of the back pressure plate to define a back pressure chamber together with the back pressure plate; a discharge guide defined in the first scroll or the second scroll to discharge the refrigerant within the back pressure chamber; and a bypass passage that transfers the refrigerant of the back pressure chamber into the discharge guide. When the discharge valve device closes the discharge hole, the refrigerant of the back pressure chamber flows through the bypass passage and the discharge guide. The bypass passage may include an intermediate pressure discharge hole that passes through at least a portion of the second scroll, and an intermediate pressure suction hole that passes through at least a portion of the back pressure plate.

The first scroll may include a first head plate disposed on the main frame, and a first wrap that extends from the first head plate in one direction. The discharge guide may include a recess part or recess that is defined by recessing at least a portion of the first wrap. The recessed part may be defined in an end surface of the first wrap, which is disposed to contact the intermediate pressure discharge hole.

The scroll compressor may further include a motor disposed in the casing to apply a rotational force to the first scroll when power is applied to the motor, When the motor is driven, the discharge valve device may open the discharge hole, and when operation of the motor stops, the discharge valve device may close the discharge hole. When the discharge valve device opens the discharge hole, the refrigerant within one compression chamber of the plurality of compression chambers may flow into the back pressure chamber through the bypass passage.

The floating plate may selectively contact a bottom surface of the discharge cover. When the discharge valve device closes the discharge hole, the floating plate may be spaced apart from the discharge cover.

Embodiments disclosed herein further provide a scroll compressor that may include a casing; a discharge cover fixed at an inside of the casing to partition the inside of the casing into a suction space and a discharge space; a main frame disposed to be spaced apart from the discharge cover; a first scroll disposed on or at a side of the main frame, the first scroll including a first wrap that performs an orbiting motion; a second scroll disposed on or at a side of the first scroll to define a plurality of compression chambers together with the first scroll, the second scroll having an intermediate pressure discharge hole that communicates with a compression chamber having an intermediate pressure among the plurality of compression chambers; a back pressure plate coupled to the second scroll to guide the refrigerant passing through the discharge hole toward the discharge cover; a floating plate movably disposed on or at a side of the back pressure plate to define a back pressure chamber together with the back pressure plate; and a recessed part or recess defined by recessing at least a portion of the first wrap to guide a flow of the refrigerant discharged from the intermediate pressure discharge hole.

The recessed part may have a predetermined width (W) and depth (D) in one surface that defines an end of the first wrap. The predetermined width (W) may be less than ⅔ times a thickness (T) of the first wrap. The predetermined depth (D) may be less than about 0.3 mm.

The second scroll may include a second head plate coupled to the back pressure plate, and a second wrap that extends from the second head plate. One surface that defines an end of the first wrap may be disposed to contact the second head plate. The recess may be defined in an end of a side of the intermediate pressure discharge hole.

The details of one or more embodiments are set forth in the accompanying drawings and the description. Other features will be apparent from the description and drawings, and from the claims.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing comprising a rotational shaft;

a discharge cover fixed at an inside of the casing to partition the inside of the casing into a suction space and a discharge space;

a first scroll rotated by the rotational shaft to perform an orbiting motion, the first scroll including a first head plate coupled to the rotational shaft and a first wrap that extends upward from the first head plate;

a second scroll disposed at an upper side of the first scroll to define a plurality of compression chambers together with the first scroll, the second scroll having an intermediate pressure discharge hole that is in fluid communication with a compression chamber having an intermediate pressure of the plurality of compression chambers;

a back pressure chamber assembly coupled to the second scroll, the back pressure chamber assembly having an intermediate pressure suction hole that is in fluid communication with the intermediate pressure discharge hole and defining a back pressure chamber; and a recess formed by recessing an end surface of the first wrap, the recess being in fluid communication with the intermediate pressure discharge hole to guide discharge of a refrigerant within the back pressure chamber, the end surface of the first wrap being configured to face the intermediate pressure discharge hole, wherein:

a radial thickness of the first wrap is greater than a radial thickness of the intermediate pressure discharge hole, when the scroll compressor stops, when the first wrap is disposed below the intermediate pressure discharge hole to close the intermediate pressure discharge hole, the refrigerant in the back pressure chamber is discharged into the compression chamber via the recess, and when the first wrap is spaced horizontally from a lower end of the intermediate pressure discharge hole to open the intermediate pressure discharge hole, the refrigerant in the back pressure chamber is directly discharged into the compression chamber.

2. The scroll compressor according to claim 1, wherein, while the refrigerant is compressed in the plurality of compression chambers, the back pressure chamber communicates with the compression chamber through the recess.

3. The scroll compressor according to claim 1, wherein the back pressure chamber assembly comprises:

a back pressure plate coupled to the second scroll, the intermediate pressure suction hole being formed in the back pressure plate; and a floating plate movably disposed at a side of the back pressure plate to define the back pressure chamber together with the back pressure plate.

4. The scroll compressor according to claim 3, wherein the second scroll comprises a second head plate coupled to the back pressure plate, and a second wrap that extends from the second head plate toward the first head plate, and wherein the recess is defined in an upper surface of the first wrap, which faces the second head plate.

5. The scroll compressor according to claim 4, wherein the recess has a width (W) of about 0.3 mm or less.

6. The scroll compressor according to claim 4, wherein the recess has a depth (D) less than ⅔ times the radial thickness (T) of the first wrap.

7. The scroll compressor according to claim 3, further comprising:

a discharge hole defined in the second scroll, that discharges refrigerant compressed in the plurality of compression chambers, the refrigerant having a discharge pressure; and an intermediate discharge hole defined in the back pressure plate to communicate with the discharge hole, thereby guiding the refrigerant toward the discharge cover.

8. The scroll compressor according to claim 7, further comprising a discharge valve movably disposed on a side of the discharge hole, wherein the discharge valve opens the discharge hole while the refrigerant is compressed and closes the discharge hole when the compression of the refrigerant stops.

9. The scroll compressor according to claim 3, wherein the floating plate further comprises a rib that protrudes toward the discharge cover, and while the refrigerant is compressed, the rib contacts the discharge cover, and when the compression of the refrigerant stops, the rib is spaced away from the discharge cover.

10. The scroll compressor according to claim 1, further comprising:

a bypass hole that passes through at least a portion of the second scroll to communicate with one compression chamber of the plurality of compression chambers; and a bypass valve that selectively opens the bypass hole.

* * * * *